US009754549B2

(12) United States Patent
Kwon et al.

(10) Patent No.: US 9,754,549 B2
(45) Date of Patent: Sep. 5, 2017

(54) SOURCE DRIVER WITH LOW OPERATING POWER AND LIQUID CRYSTAL DISPLAY DEVICE HAVING THE SAME

(71) Applicant: SAMSUNG ELECTRONICS CO., LTD., Suwon-si (KR)

(72) Inventors: Jaewook Kwon, Hwaseong-si (KR); Jihoon Kim, Seoul (KR); Jun-Jae Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 16 days.

(21) Appl. No.: 14/803,281

(22) Filed: Jul. 20, 2015

(65) Prior Publication Data

US 2016/0098967 A1 Apr. 7, 2016

(30) Foreign Application Priority Data

Oct. 2, 2014 (KR) ..... 10-2014-0133452

(51) Int. Cl.
*G09G 3/36* (2006.01)

(52) U.S. Cl.
CPC ..... *G09G 3/3688* (2013.01); *G09G 3/3614* (2013.01); *G09G 2310/0291* (2013.01); *G09G 2310/0294* (2013.01)

(58) Field of Classification Search
None
See application file for complete search history.

(56) References Cited

U.S. PATENT DOCUMENTS 6,104,364 A * 8/2000 Hayashi ..... G09G 3/3685 345/87
6,275,210 B1 * 8/2001 Maekawa ..... G09G 3/3688 345/100
6,567,066 B1 * 5/2003 Hashimoto ..... G09G 3/3688 345/100
6,806,860 B2 * 10/2004 Saito ..... G09G 3/3688 345/89
6,816,144 B2 * 11/2004 Tsuchi ..... G09G 3/3688 345/100
7,136,039 B2 * 11/2006 Bu ..... G09G 3/3648 345/100
7,239,297 B2 * 7/2007 Tajima ..... G09G 5/006 345/690
7,737,932 B2 * 6/2010 Kato ..... G09G 3/3688 345/690
7,839,370 B2 * 11/2010 Izumikawa ..... G09G 3/3648 345/204
7,986,288 B2 * 7/2011 Jang ..... G09G 3/3688 345/204
8,089,437 B2 * 1/2012 Maekawa ..... G09G 3/3655 345/212

(Continued)

FOREIGN PATENT DOCUMENTS

KR 10-2012-0085076 A 7/2012

*Primary Examiner* — Dismery Mercedes
(74) *Attorney, Agent, or Firm* — Sughrue Mion, PLLC

(57) ABSTRACT

Provided are a source driver configured to drive a data line of a display panel and a liquid crystal display (LCD) device including the same. The source drive configured to compare whether data of consecutive gate lines in the display panel and data of adjacent data lines in the display panel are identical or not, and selectively disable output amplifiers connected to the data line having identical data.

20 Claims, 17 Drawing Sheets

(56) References Cited

U.S. PATENT DOCUMENTS

| | | | | |
|---|---|---|---|---|
| 8,144,100 | B2 | 3/2012 | Woo et al. | |
| 8,289,307 | B2 | 10/2012 | Chiang et al. | |
| 8,305,313 | B2 * | 11/2012 | Furuya | G09G 3/006 345/204 |
| 8,537,092 | B2 | 9/2013 | Woo et al. | |
| 2004/0179029 | A1 * | 9/2004 | Ogawa | G09G 3/3688 345/690 |
| 2007/0097059 | A1 * | 5/2007 | Tanaka | G09G 3/3648 345/98 |
| 2011/0025656 | A1 * | 2/2011 | Huang | G09G 3/3688 345/204 |
| 2011/0032245 | A1 * | 2/2011 | Inokuchi | G02F 1/1345 345/212 |
| 2012/0026152 | A1 * | 2/2012 | Chung | G09G 3/3688 345/212 |
| 2012/0176391 | A1 * | 7/2012 | Woo | G09G 5/02 345/549 |
| 2012/0188224 | A1 | 7/2012 | Lee et al. | |
| 2014/0198087 | A1 * | 7/2014 | Knausz | G06F 1/3218 345/212 |

* cited by examiner

FIG. 6B

| time | $t_0-t_1$ | $t_1-t_2$ | $t_2-t_3$ | after $t_3$ |
|---|---|---|---|---|
| 139-1 | ON | ON | ON | ON |
| 139-3 | ON | OFF | OFF | ON |

FIG. 7

| | | | | | | |
|---|---|---|---|---|---|---|
| SYNC_DATA0[7:0] | 1 | 7 | 13 | 19 | 25 | ··· |
| SYNC_DATA1[7:0] | 2 | 8 | 14 | 20 | 26 | ··· |
| SYNC_DATA2[7:0] | 3 | 9 | 15 | 21 | 27 | ··· |
| SYNC_DATA3[7:0] | 4 | 10 | 16 | 22 | 28 | ··· |
| SYNC_DATA4[7:0] | 5 | 11 | 17 | 23 | 29 | ··· |
| SYNC_DATA5[7:0] | 6 | 12 | 18 | 24 | 30 | ··· |
| XOR_ODD[0] | 1⊕3 | 7⊕9 | 13⊕15 | 19⊕21 | 25⊕27 | ··· |
| XOR_EVEN[0] | 2⊕4 | 8⊕10 | 14⊕16 | 20⊕22 | 26⊕28 | ··· |
| XOR_ODD[1] | 3⊕5 | 9⊕11 | 15⊕17 | 21⊕23 | 27⊕29 | ··· |
| XOR_EVEN[1] | 4⊕6 | 10⊕12 | 16⊕18 | 22⊕24 | 28⊕30 | ··· |

| | | | | | | |
|---|---|---|---|---|---|---|
| SYNC_DATA0[7:0] | 1 | 4 | 7 | 10 | 13 | ··· |
| SYNC_DATA1[7:0] | 2 | 5 | 8 | 11 | 14 | ··· |
| SYNC_DATA2[7:0] | 3 | 6 | 9 | 12 | 15 | ··· |
| XOR_RED | 1⊕4 | 4⊕7 | 7⊕10 | 10⊕13 | 13⊕16 | ··· |
| XOR_GREEN | 2⊕5 | 5⊕8 | 8⊕11 | 11⊕14 | 14⊕17 | ··· |
| XOR_BLUE | 3⊕6 | 6⊕9 | 9⊕12 | 12⊕15 | 15⊕18 | ··· |

SOURCE DRIVER WITH LOW OPERATING POWER AND LIQUID CRYSTAL DISPLAY DEVICE HAVING THE SAME

CROSS-REFERENCE TO RELATED APPLICATION

This application claims priority from Korean Patent Application No. 10-2014-0133452, filed on Oct. 2, 2014, in the Korean Intellectual Property Office, the entire disclosure of which is incorporated herein by reference.

BACKGROUND

Field

Apparatuses and methods consistent with exemplary embodiments relate to a liquid crystal display device, and more particularly, to a source driver with a low operating power and a liquid crystal display device having the same.

Description of Related Art

Recently, various types of flat display devices have been developed and applied to portable information devices and IT products. A liquid crystal display (LCD) device of the flat display devices is suitable for portable devices, and now applications of the LCD device are being expanded to note book computers, monitors, a spaceship, an aircraft, etc.

The LCD device includes control switches arranged in a form of a matrix. For example, the control switches adjust a transmittance of light, which passes through a liquid crystal layer, according to an image signal applied to thin film transistors (TFTs), and then a desired image can be obtained.

The LCD device is suitable for devices and applications which require a small size, a light weight, and low power consumption, and devices having lower power consumption are the trend in research and development.

SUMMARY

According to an aspect of an exemplary embodiment, there is provided a source driver including a plurality of output amplifiers configured to drive data lines of a display panel, wherein the source driver may compare whether data of consecutive gate lines in the display panel and data of adjacent data lines in the display panel are identical, and selectively disable output amplifiers connected to the data line having identical data.

The source driver may include a logic controller configured to receive input data and provide a comparison result between data of the adjacent data lines, a shift register configured to provide the input data and the comparison result transmitted from the logic controller using a shift clock, a data latch configured to sequentially latch data transmitted from the shift register, and compare data in a previous gate line with data in a current gate line, a digital-to-analog (DA) converter configured to convert data transmitted from the data latch to an analog voltage, and an output buffer configured to output data transmitted from the DA converter.

The logic controller may compare data of the adjacent data lines, and provides "1" when the data is identical or "0" when the data is different as the comparison result.

The data latch may control the output amplifier to be enabled or disabled using the comparison result between data of the gate lines and the comparison result between data of the adjacent data lines.

The data latch may selectively disable some of the output amplifiers connected to the data line in response to determining that the comparison result between data of the gate lines and the comparison result between data of the adjacent data lines are identical.

The data latch may detect receiving of a new image data in response to determining that data of consecutive gate lines are different while data of adjacent data lines are the same, and enable all of the plurality of output amplifiers.

The plurality of output amplifiers may be selectively enabled or disabled according to an amplifier switch control signal, and the data latch may provide an enabled amplifier switch control signal if data of consecutive gate lines and data of adjacent data lines are same, and provide a disabled amplifier switch control signal if data of consecutive gate lines and data of adjacent data lines are different.

According to an aspect of another exemplary embodiment, there is provided a liquid crystal display (LCD) device including a source driver configured to drive a data line of a display panel and comprise a plurality of output amplifiers, wherein the source driver may adjust current of the plurality of output amplifiers using a comparison result of whether image data of adjacent columns is identical or not, and a comparison result of whether image data of consecutive rows is identical or not.

A condition of a gamma voltage applied to a data line disposed in the columns may be used when comparing whether image data is identical or not by the columns.

The LCD device may include a timing controller configured to receive the image data and provide a timing related signal and an operation control signal, a gate driver configured to provide a gate turn-on voltage controlled by the timing controller, the source driver controlled by the timing controller and configured to provide pixel data corresponding to the image data, and a panel configured to include a plurality of unit pixels at intersections of a plurality of gate lines and a plurality of data lines and display an image controlled by the gate driver and the source driver.

The source driver may include a logic controller configured to receive the image data and provide a comparison result of mutual image data when data lines have an identical condition of the gamma voltage, a shift register configured to provide the image data and the comparison result transmitted from the logic controller using a shift clock, a data latch configured to sequentially latch data transmitted from the shift register and compare image data in a current row with image data in a subsequent row, a DA converter configured to convert data transmitted from the data latch to an analog voltage, and an output buffer including the plurality of output amplifiers which output data transmitted from the DA converter.

The logic controller may perform a comparison operation on columns having identical polarity of a gamma voltage applied to each column when the panel includes a thin film transistor (TFT) LCD device.

The logic controller may perform a comparison operation on columns in which identical color filters are disposed, when the panel includes an organic light-emitting diode (OLED) device.

The data latch may provide an enabled amplifier switch control signal when data of the consecutive rows is identical and data of columns having an identical condition of a gamma voltage is identical.

A static current of output amplifiers may be reduced in response to receiving the enabled amplifier switch control.

The output amplifiers in which the static current is reduced may be some output amplifiers connected to pixels disposed in the columns having the identical condition of the gamma voltage.

A switch may be connected between output nodes of the output amplifiers connected to the pixels disposed in the columns having the identical condition of the gamma voltage.

According to an aspect of another exemplary embodiment, there is provided a liquid crystal display (LCD) device including a source driver configured to drive a data line of a display panel and comprises a plurality of output amplifiers, wherein the source driver may control some of the plurality of output amplifiers connected to columns with respect to columns which display an identical image to be selectively disabled according to determining of whether data of current and subsequent rows is changed or not.

The LCD device may use a gamma voltage condition applied to pixels disposed in the columns when determining whether the image data is identical or not by the columns.

The source driver may provide an amplifier switch control signal which selectively disables output amplifiers connected to the columns having identical image data by determining whether image data of consecutive rows and adjacent columns is identical or not.

The output amplifiers receiving the enabled amplifier switch control signal may be disabled.

The disabled output amplifiers may be some output amplifiers connected to pixels disposed in columns having an identical condition of the gamma voltage.

BRIEF DESCRIPTION OF THE DRAWINGS

The above and/or other aspects will become more apparent by describing in detail exemplary embodiments with reference to the accompanying drawings, in which:

FIG. 6B is a state table of output amplifiers;

FIG. 7 is a state table illustrating serial data groups and comparison data;

DETAILED DESCRIPTION OF EXEMPLARY EMBODIMENTS

Figure 1:
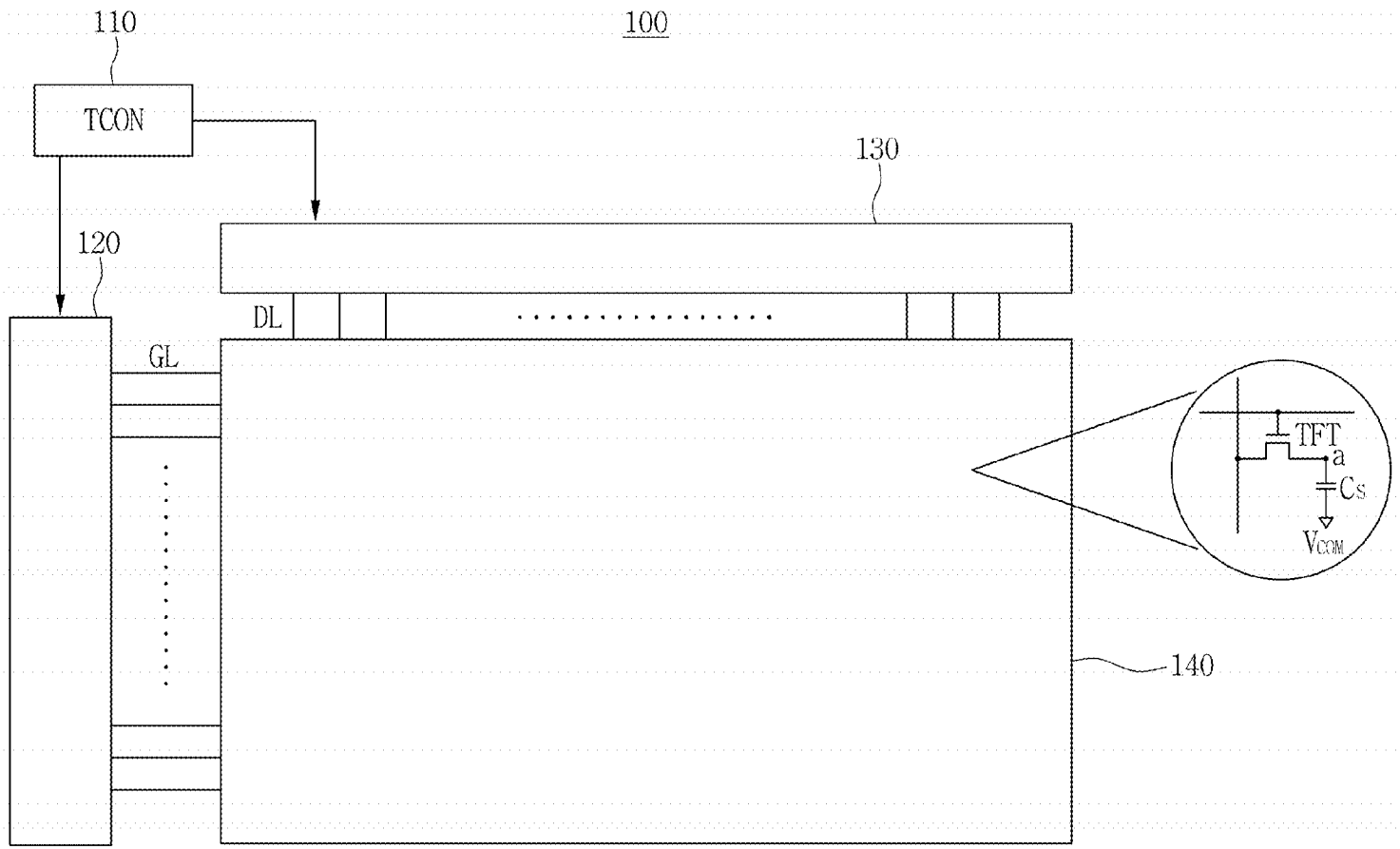
FIG. 1 is a block diagram illustrating a liquid crystal display (LCD) device according to an exemplary embodiment.

Hereinafter, exemplary embodiments will be described in detail with reference to the accompanying drawings. In detailed descriptions of the exemplary embodiments, detailed descriptions of well-known configurations unrelated to the gist of the inventive concept will be omitted. In this specification, when reference numerals are assigned to components of each drawing, it should be noted that, although the same components are illustrated in different drawings, the same numerals are assigned as much as possible.

Specific structural and functional details disclosed herein are merely representative for purposes of describing exemplary embodiments, however, exemplary embodiments may be embodied in many alternate forms and should not be construed as limited to exemplary embodiments set forth herein.

While the inventive concept is susceptible to various modifications and alternative forms, specific embodiments thereof are shown by way of example in the drawings and will be described in detail. It should be understood, however, that there is no intent to limit the inventive concept to the particular forms disclosed, but on the contrary, the inventive concept is to cover all modifications, equivalents, and alternatives falling within the spirit and scope of the inventive concept.

It will be understood that, although the terms "first," "second," etc. may be used herein to describe various components, these components should not be limited by these terms. These terms are only used to distinguish one component from another component. Thus, a first component discussed below could be termed a second component and the second component discussed below could be termed the first component without departing from the teachings of the exemplary embodiments.

It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements. Other words used to describe relationships between elements should be interpreted in a like fashion (i.e., "between" versus "directly between," "adjacent" versus "directly adjacent," etc.).

The terminology used herein is for the purpose of describing particular exemplary embodiments only and is not intended to be limiting of the exemplary embodiments. As used herein, the singular forms "a," "an," and "the," are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which exemplary embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Meanwhile, when it is possible to implement any exemplary embodiment in any other way, a function or an operation specified in a specific block may be performed differently from a flow specified in a flowchart. For example, two consecutive blocks may actually perform the function or the operation simultaneously, and the two blocks may perform the function or the operation conversely according to a related operation or function.

FIG. 1 is a block diagram simply illustrating a liquid crystal display (LCD) device 100 according to an exemplary embodiment.

Referring to FIG. 1, the LCD device 100 may include a timing controller (TCON) 110, a gate driver 120, a source driver 130, and a panel 140.

The TCON 110 may receive image data and various control signals from the outside, and control operations of the gate driver 120 and the source driver 130. Although not shown, the various control signals may include a horizontal sync signal, a vertical sync signal, a clock signal, etc.

The TCON 110 may output general control signals, such as a driving signal which controls the gate driver 120 and a driving signal which controls the source driver 130, which respectively control operations of the gate driver 120 and the source driver 130. Therefore, in a predetermined operation mode, the TCON 110 may control the gate driver 120 to drive gate lines GL in a continuous manner. Further, the TCON 110 may control image data signals RGB, received from the outside so as to selectively apply to each of pixels arranged in the gate lines GL which are sequentially enabled. The image data RGB may include, for example, red image data (R), green image data (G) and blue image data (B), however, the image data RGB is not limited thereto.

The gate driver 120 may include a plurality of gate drivers which drive the gate lines GL included in the panel 140. The gate driver 120 sequentially applies a gate turn-on voltage to the gate lines GL. Thus, whether a corresponding cell transistor is turned on or not may be controlled so that a gradation voltage to be applied to each pixel is applied to a corresponding pixel.

The source driver 130 may include a plurality of output amplifiers which drive data lines DL. The source driver 130 may be controlled by the TCON 110 and may provide image data (R, G, and B), that is, pixel data, to the data lines DL included in the panel 140. Therefore, the source driver 130 may control to display full colors through a combination of R, G, and B pixels.

Specifically, the source driver 130 according to the exemplary embodiment may compare data in consecutive gate lines GL and adjacent data lines DL to determine whether data therein is identical, and control so that some amplifiers connected to data lines DL which have the same data may not be operated. Therefore, in the LCD device 100 according to the exemplary embodiment, static current may be decreased, and current consumption can be reduced.

When image data is displayed on a display panel, adjacent cells included in the image data have the same image data in many cases. That is, in most cases, adjacent cells have the same color in a predetermined region. In the case of the same color in a predetermined region, if amplifiers related to R, G, and B channels of all data lines DL are driven, current consumption is very high.

However, when data (color) of two adjacent cells is identical, the LCD device 100 according to the exemplary embodiment may control so that one amplifier related to one cell of the adjacent cells may be enabled and another amplifier related to the other cell having the same data as the one cell may be disabled. Description of this case will be described with reference to accompanying drawings in detail.

The panel 140 may include a plurality of unit pixels arranged in a form of matrix at intersections of the plurality of gate lines GL and the plurality of data lines DL. Pixels arranged in any one row are commonly connected to any one gate line GL, and pixels arranged in any one column are commonly connected to any one data line DL.

For example, the unit pixel may include a switching device TFT connected to the gate line GL and the data line DL, and a liquid crystal capacitor Cs connected to the switching device TFT. Specifically, the liquid crystal capacitor Cs has two terminals which are respectively connected to a drain terminal (a) of the switching device TFT and a common voltage electrode $V_{COM}$, and a dielectric layer having dielectric anisotropy is formed between the two terminals.

In an operation of the unit pixels, when a driving signal is applied to one gate line GL by the gate driver 120, switching devices TFT connected to the gate line GL are turned on. Pixel data applied to a data line DL by the source driver 130 through the switching devices TFT is transmitted to a drain terminal (a) of each switching device TFT turned on by the gate driver 120. Thus, a liquid crystal orientation state of a liquid crystal cell (not shown) is changed by an electric field generated between the two terminals of the liquid crystal capacitor Cs, and then an image is displayed.

Figure 2:
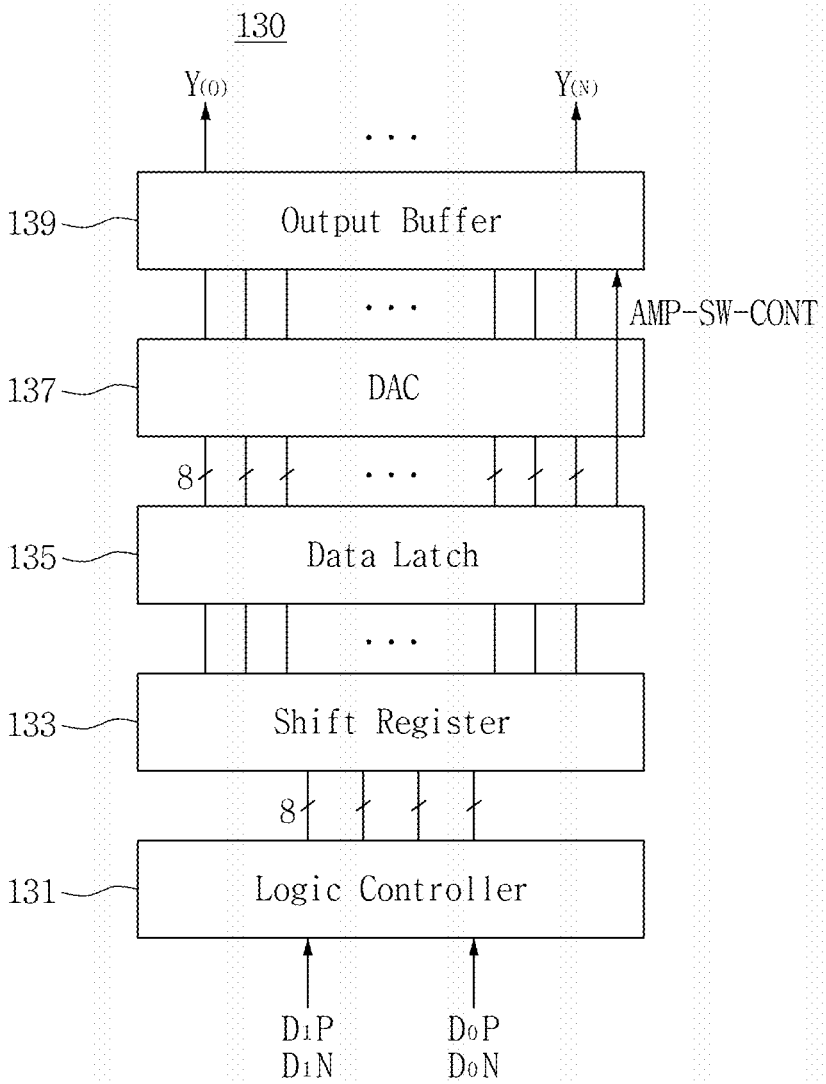
FIG. 2 is a block diagram of a source driver of FIG. 1.

FIG. 2 is a block diagram of the source driver 130 of FIG. 1.

Referring to FIG. 2, the source driver 130 may include a logic controller 131, a shift register 133, a data latch 135, a digital-to-analog converter (DAC) 137, and an output buffer 139.

The logic controller 131 may receive input data $D_0P$, $D_0N$, $D_1P$, and $D_1N$ and provide the received input data $D_0P$, $D_0N$, $D_1P$, and $D_1N$ to the shift register 133. Further, the logic controller 131 according to the exemplary example embodiment may provide comparison data XOD_DATA to the shift register

133. Here, as the comparison data XOR_DATA is data resulted from comparing data of adjacent pixels, that is, adjacent data lines DL, output amplifiers of a source driver are controlled to be enabled or disabled using the comparison data XOR_DATA.

The logic controller 131 may be an interface unit which controls differences of operation timings, signal voltages, data expression formats, and/or the like so as to internally process external data.

The shift register 133 may provide data received from the logic controller 131 to the data latch 135. The shift register 133 may include a plurality of shift registers (not shown) which sequentially shifts image data (i.e., input data $D_0P$, $D_0N$, $D_1P$, and $D_1N$) and comparison data XOR_DATA using a shift clock and outputs the shifted image data.

The data latch 135 according to the exemplary embodiment may sequentially latch digital image data in response to a sampling signal supplied from the shift register 133 and provide the latched digital image data to the DAC 137. The data latch 135 may be formed by a plurality of latches to latch the plurality of the digital image data. Further, each of the plurality of latches has a size corresponding to the number of bits of the digital image data. Specifically, the data latch 135 according to the exemplary embodiment may compare data between consecutive gate lines GL, that is, row by row.

Consequentially, the data latch 135 may provide an amplifier switch control signal AMP-SW-CONT to the output buffer 139 using comparison data XOR_DATA which includes a comparison result between rows and a comparison result between columns in the logic controller 131.

The data latch 135 may provide an enabled amplifier switch control signal AMP-SW-CONT when data in a subsequent row is the same as the comparison data XOR_DATA. Further, the data latch 135 may provide a disabled amplifier switch control signal AMP-SW-CONT when data in the subsequent row is different from the comparison data XOR_DATA.

When data in consecutive rows is different even though adjacent pixels (connected to the same gate line) have the same data, the data latch 135 detects a state in which adjacent image data is changed, and disables the amplifier switch control signal AMP-SW-CONT.

In the conventional case, when data adjacent pixels are the same, one of the two amplifiers is activated, and the other amplifier is inactivated, and the two amplifiers share the data to reduce the current consumption.

However, when an image data value is changed (e.g., from R pixel data to G pixel data), since an adjacent pixel has still the same image data value even though it is based on the changed image data value, an amplifier of any one pixel is still disabled in a previous state. Since the image data value is changed, a value of a common voltage supplied to an enabled amplifier of any one pixel is changed. At this time, an amount of charge charged in a capacitor connected to the enabled amplifier is different from the previous state. Accordingly, leakage current may be generated because an amount of charge is different between the enabled amplifier and the disabled amplifier due to a voltage change in the previous state and the changed image data value. Thus, a low quality image may be generated.

Meanwhile, according to the exemplary embodiment, when data in consecutive gate lines GL is different even though data of adjacent pixels (based on a data line) are the same, it may be detected that new image data is received. Therefore, the previous state may be reset by enabling all amplifiers connected to the source driver 130 (see FIG. 1) connected to a corresponding region.

According to the exemplary embodiment, the leakage current generated by a different amount of charge between previous image data and current image data may be prevented by enabling all amplifiers connected to the source driver 130 with respect to pixels of data lines DL connected to a gate line GL in which an image data value is changed.

The DAC 137 may convert latched digital image data to analog image data.

The DAC 137 may convert digital image data transmitted from the data latch 135 to the analog image data, that is, data voltages, and transmits the converted analog image data to the output buffer 139. The DAC 137 may convert the digital image data transmitted from the data latch 135 to analog data voltages having a positive polarity (+) and a negative polarity (−) and output the converted analog data voltages. The DAC 137 may perform digital-to-analog conversion of image data using a predetermined number of positive (+) gamma voltages and a predetermined number of negative (−) gamma voltages.

The output buffer 139 provides output data Y0 to YN by transmitting the received analog image data to data lines DL of the panel 140 (see FIG. 1). The output buffer 139 includes a plurality of output amplifiers (not shown). Specifically, the output buffer 139 according to the exemplary embodiment may selectively control that the output amplifiers (not shown) are enabled or disabled, using the amplifier switch control signal AMP-SW-CONT.

Figure 3:
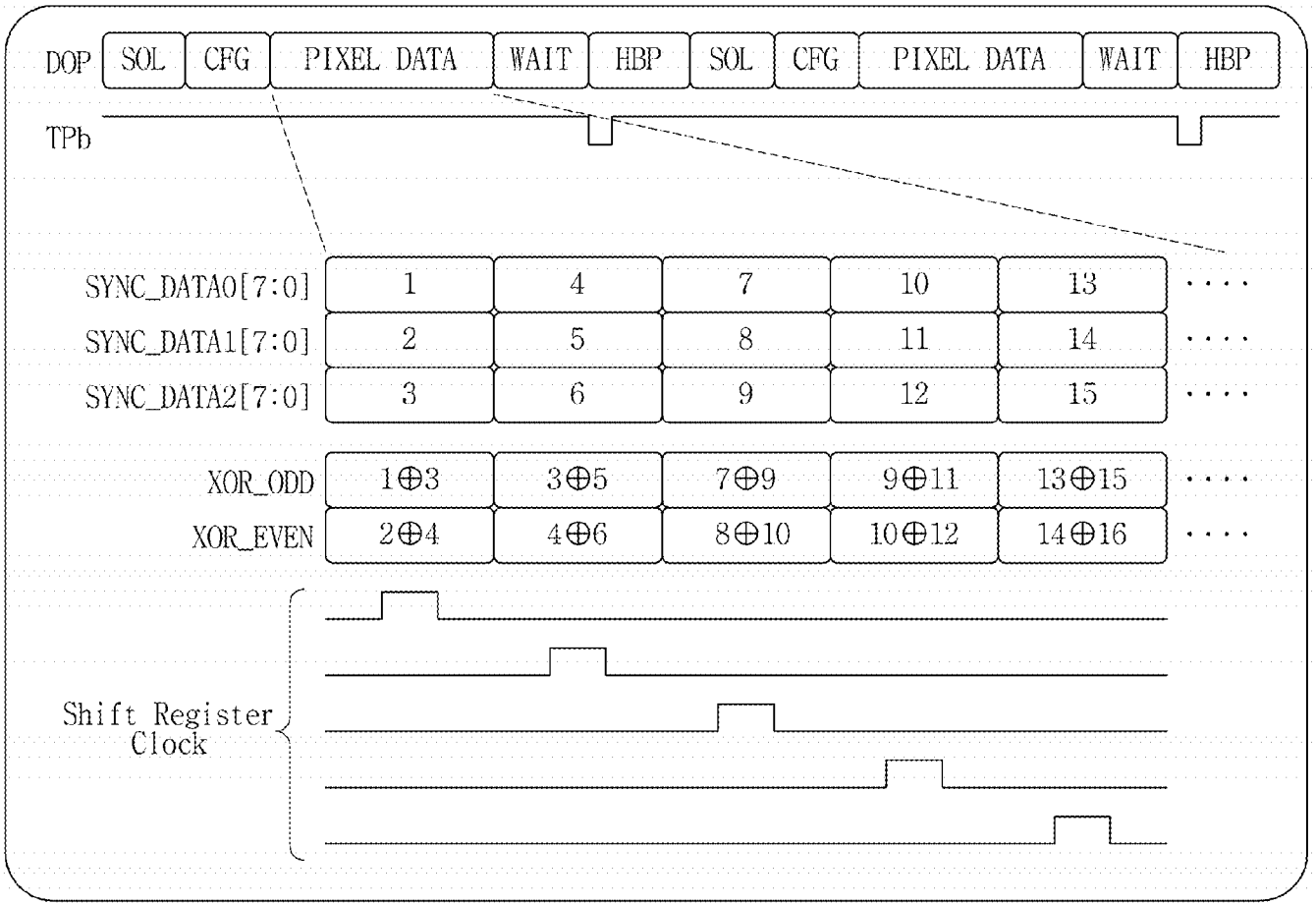
FIG. 3 is a conceptual view illustrating some operations of a logic controller and a shift register of FIG. 2.

FIG. 3 is a conceptual view illustrating some operations of the logic controller 131 and the shift register 133 of FIG. 2.

Referring to FIGS. 1 and 3, a configuration of an interface packet form of the logic controller 131 may be formed to have a processing sequence of a start of line (SOL), a configuration (CFG), a pixel data line (PIXEL DATA), waiting (WAIT), a horizontal blank period (HBP), etc.

In a period of the SOL, the TCON 110 may control to start transmission of a data stream to the source driver 130.

In a period of the CFG, a value of a register included in the source driver 130 may be updated.

In a period of the PIXEL DATA, display data, that is, pixel data, may be transmitted to the source driver 130.

In a period of the WAIT, the pixel data may be processed in the source driver 130.

A period of the HBP is a time period at which a corresponding horizontal line of a panel is driven. That is, an operation in a previous period is maintained until receiving line data having display information with respect to a subsequent horizontal line. This period may be an operating period in response to a timing control signal TPb transmitted from the TCON 110.

As described above, the HBP which is a waiting period is performed before receiving a new data stream, and the SOL which starts transmission of packet data may be performed continuously.

While one example of an interface has been disclosed for the sake of convenience, but the interface is not limited thereto and various packet forms may be applied.

The period of the PIXEL DATA will be described in detail as follows.

In the period of the PIXEL DATA, serialized data may be substantially provided.

Here, data having 2×2 pixels per unit will be exemplified for the sake of convenience.

When data received in R, G, and B pixels is transmitted using 8 buses (not shown), the data may be transmitted after being divided into serial data groups, such as SYNC_DATA0 [7:0], SYNC_DATA1 [7:0], and SYNC_DATA2 [7:0]. As shown in FIG. 3, the serial data groups are respectively transmitted to an $N-1^{th}$ row, an $N^{th}$ row, and an $N+1^{th}$ row. Here, the $N-1^{th}$ row, the $N^{th}$ row, and the $N+1^{th}$ row denote arbitrarily consecutive rows.

It is assumed that first data of the first data group SYNC_DATA0 [7:0] is provided to odd columns of the $N-1^{th}$ row as an R pixel, first data of the second data group SYNC_DATA1 [7:0] is provided to odd columns of the $N^{th}$ row as a G pixel, and first data of the third data group SYNC_DATA2 [7:0] is provided to odd columns of the $N+1^{th}$ row as a B pixel.

According to characteristics of a thin film transistor (TFT) LCD, the polarity of a gamma voltage applied to a pixel is formed by alternately applying positive (+) and negative (−) polarities. Accordingly, in the data having 2×2 pixels per unit, odd columns have the same polarity and even columns have the same polarity at the same time. That is, when positive polarity (+) of the gamma voltage is applied to the odd columns, negative polarity (−) of the gamma voltage is applied to the even columns.

In accordance with the exemplary embodiment, comparison data XOR_ODD and XOR_EVEN are generated to compare pixels having identical polarity. For example, it is determined whether a pixel data value is identical or not by comparing first data of the first data group SYNC_DATA0 [7:0] with first data of the third data group SYNC_DATA2 [7:0], that is, 1 and 3 in FIG. 3. Likewise, it is determined whether a pixel data value is identical or not by comparing first data of the second data group SYNC_DATA1 [7:0] with second data of the first data group SYNC_DATA0 [7:0], that is, 2 and 4 in FIG. 3. For example, "1" may be transmitted when the result of comparison is identical, and "0" may be transmitted when the result of comparison is different. The above-described process may be processed in the logic controller 131.

The comparison data XOR_ODD and XOR_EVEN are transmitted to the data latch 135 (see FIG. 2) in every shift register clock.

Figure 4:
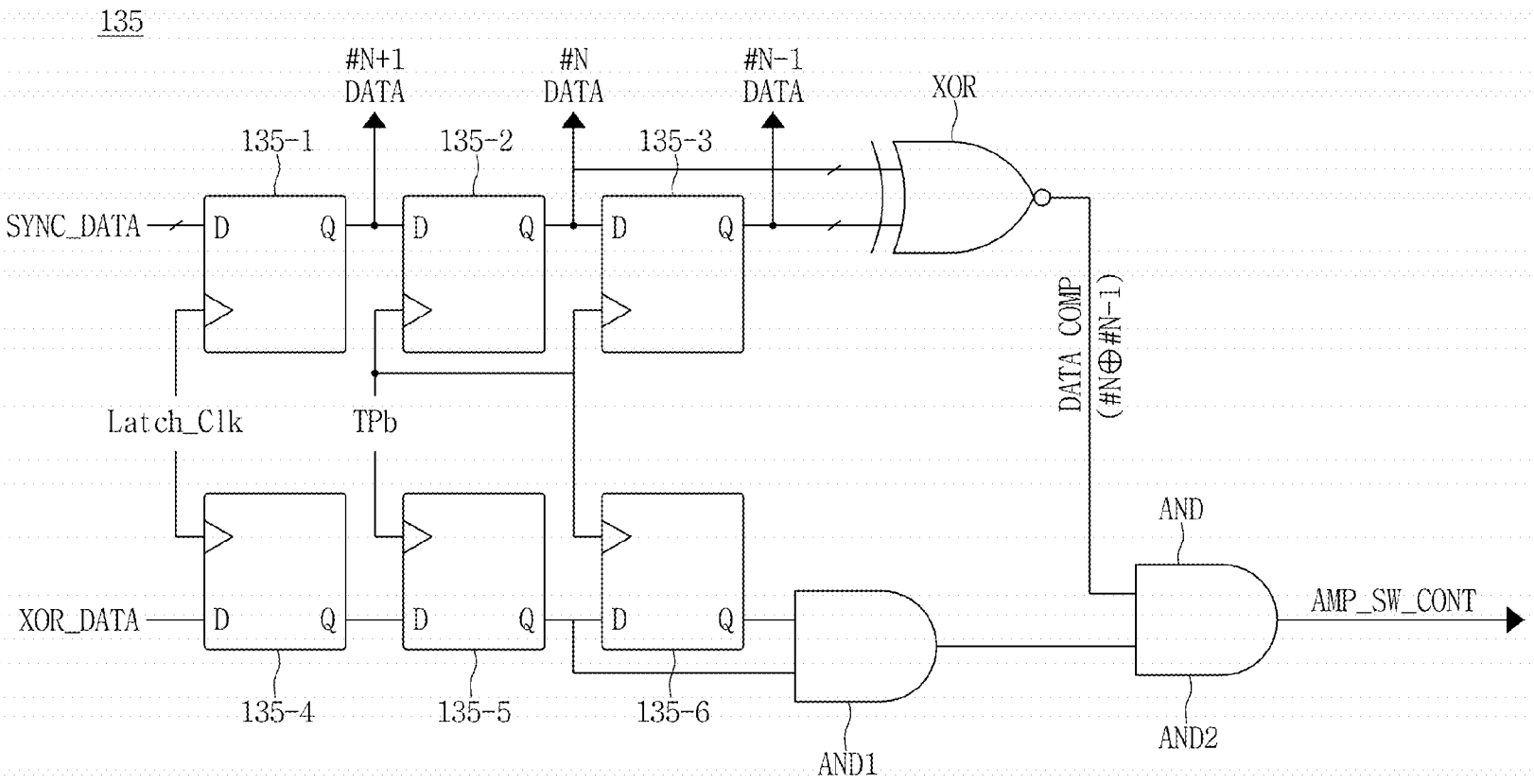
FIG. 4 is a block diagram of a data latch of FIG. 2.

FIG. 4 is a block diagram of the data latch 135 of FIG. 2.

Referring to FIG. 4, the data latch 135 may include a plurality of flip-flops 135-1, 135-2, 135-3, 135-4, 135-5, and 135-6, an XOR device (XOR), and first and second AND devices (AND1 and AND2).

The first to third flip-flops 135-1, 135-2, and 135-3 may be connected in series, and serially transmit data SYNC_DATA received in the first flip-flop 135-1. Here, data is received through a row, that is, a gate line GL.

The XOR compares pixel data values of $N^{th}$ data (i.e., #N DATA) and $N-1^{th}$ data (i.e., #(N−1) DATA) to determine whether the values are different or not. The XOR is a comparator, and may be changed to a comparison circuit or another circuit having a comparison function instead of an XOR gate.

The fourth to sixth flip-flops 135-4, 135-5, and 135-6 may serially transmit comparison data XOR_DATA received in the fourth flip-flop 135-4.

Here, the comparison data XOR_DATA denotes the comparison data XOR_ODD and XOR_EVEN, which is a comparison of odd columns and even columns, as described in FIG. 3.

The first AND device AND1 performs a logical AND on an output signal of the fifth flip-flop 135-5 and an output signal of the sixth flip-flop 135-6, and outputs an output signal of the logical AND.

The second AND device AND2 performs a logical AND on a comparison result of the XOR and an output signal of the AND1, and outputs an output signal of the logical AND.

Hereinafter, an operation of the data latch 135 will be described in detail.

The data latch 135 sequentially transmits serialized data, that is, pixel data SYNC_DATA.

Here, a clock for controlling an operation of the first flip-flop 135-1 may be a clock for a receiving operation, for example, a latch clock Latch_Clk.

When the receiving operation is started in the first flip-flop 135-1, the second flip-flop 135-2 receives data from the first flip-flop 135-1 in series. A clock for controlling an operation of the second flip-flop 135-2 may be a clock related to an output and transmission, for example, a timing control clock TPb. However, the clock is not limited thereto.

Subsequently, data of the second flip-flop 135-2 is transmitted to the third flip-flop 135-3.

An output of each flip-flop 135-1, 135-2, and 135-3 at a predetermined time is to be data received in each row. Thus, by outputting of each flip-flop 135-1, 135-2, and 135-3, the data may be output in parallel. The data may be provided to the DAC 137 (see FIG. 2).

The XOR compares outputs of the second flip-flop 135-2 and the third flip-flop 135-3. The data latch 135 according to the exemplary embodiment determines whether data of consecutive rows, that is, a pixel data value of a current row and a pixel data value of a subsequent row, is identical or not, using the XOR. Therefore, when the comparison result between the pixel data value received in the subsequent row and the pixel data value received in the current row is identical, "1" is provided as an output of the XOR. When the comparison result is different, "0" is provided as the output of the XOR.

Meanwhile, comparison data XOR_DATA (i.e., XOR_ODD and XOR_EVEN) is received in the fourth flip-flop 135-4 and provided to the first AND device AND1 through the fifth flip-flop 135-5 and the sixth flip-flop 135-6. The fourth flip-flop 135-4 is controlled by the latch clock Latch_Clk, and the fifth flip-flop 135-5 and the sixth flip-flop 135-6 are controlled by the timing control clock TPb.

The first AND device AND1 performs a logical AND on output signals of the fifth flip-flop 135-5 and the sixth flip-flop 135-6, and outputs the output signal of the logical AND.

The second AND device AND2 performs a logical AND on the output of the XOR device XOR and the output signal of the first AND device AND1.

Therefore, when the second AND device AND2 receives "1" from the XOR and "1" from the first AND device AND1, an enabled amplifier switch control signal AMP_SW_CONT may be output.

According to the exemplary embodiment, in addition to comparison of pixel data values by columns, comparison of pixel data values by rows is also performed to detect whether the pixel data values are changed or not.

That is, the source driver according to the exemplary embodiment determines whether pixel data values are identical or not by columns and detects whether pixel data values are identical or not by consecutive rows. When the pixel data values are determined as identical, an enabled amplifier switch control signal AMP_SW_CONT is output. The amplifier switch control signal AMP_SW_CONT is provided to the output buffer 139 (see FIG. 2), and then some buffers of the output buffer 139 may be selectively disabled.

Although a pixel data value different from a pixel data value provided in a previous row is provided when a row is changed, the conventional case is only determined by whether data between adjacent pixels is identical or not (based on a column). Thus, the previous control operation may be continuously performed with respect to a disabled amplifier.

However, according to the exemplary embodiment, when a pixel data value different from a pixel data value provided in a previous row is provided when a row is changed, although pixel data between adjacent pixels (based on a column) is identical, all amplifiers may be newly enabled.

As described above, when an image data value is changed (e.g., from R to G) in the conventional case, an enabled amplifier and a disabled amplifier have different common voltages due to a voltage change in a previous state and the changed image data value. Thus, leakage current may be generated due to the different common voltages.

However, according to the exemplary embodiment, states of pixels by rows are considered in addition to states of pixels by columns. Therefore, an image failure caused by a slew rate difference between adjacent channels, which may be generated in a capacitor connected to an output driver because a pixel data value is changed from a previous pixel data value, may not be generated.

Figure 5A:
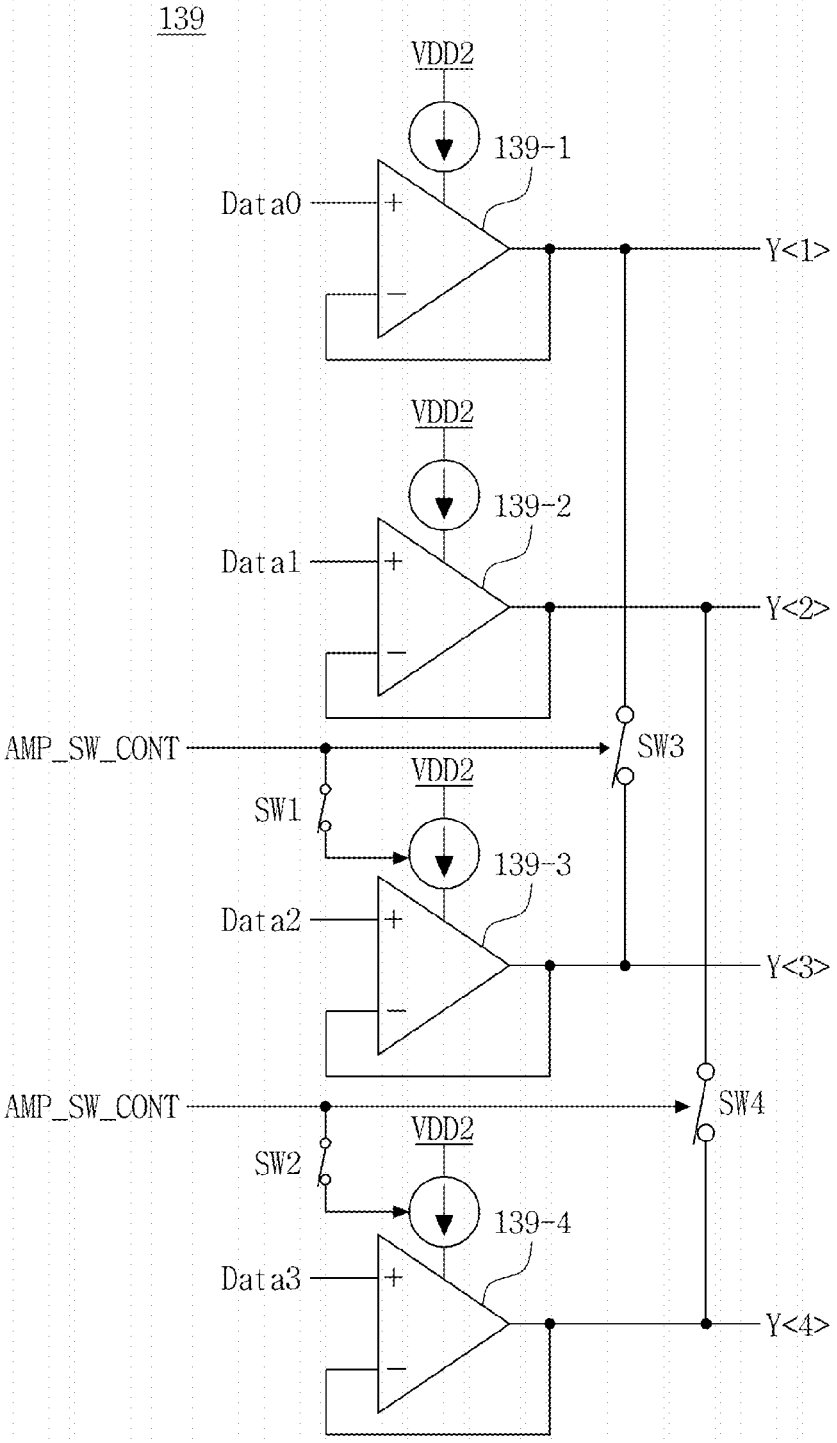
FIGS. 5A and 5B are views illustrating block diagrams and operations of an output buffer of FIG. 2.
Figure 5B:
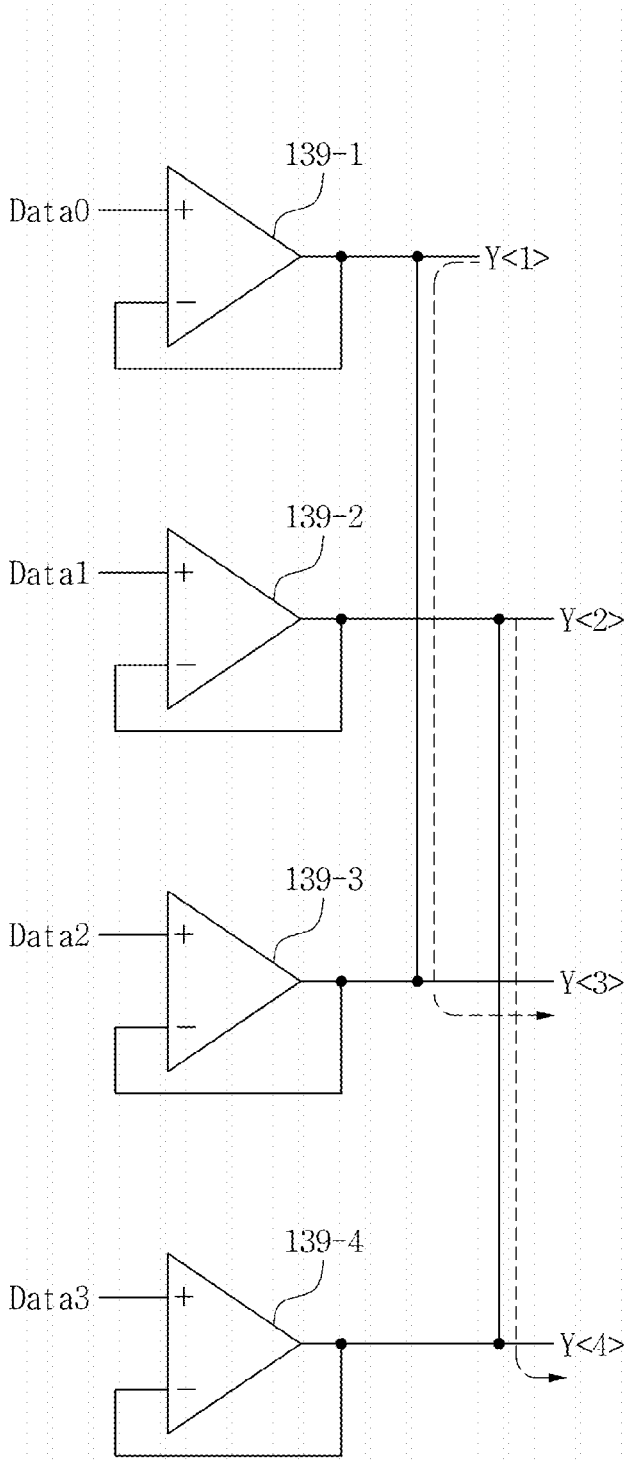

FIGS. 5A and 5B are views illustrating block diagrams and operations of an output buffer 139 of FIG. 2.

Referring to FIG. 5A, the output buffer 139 may include a plurality of output amplifiers 139-1, 139-2, 139-3, and 139-4 and a plurality of switches SW1 to SW4.

Here, four output amplifiers and four switches are described to exemplify four outputs for the sake of convenience, but a number thereof are not limited thereto.

Pixel data Data0 is received in the first output amplifier 139-1 and is provided as a first output Y<1>.

Pixel data Data1 is received in the second output amplifier 139-2 and is provided as a second output Y<2>.

Likewise, pixel data Data2 and Data3 are received in the third output amplifier 139-3 and the fourth output amplifier 139-4, respectively, and provided as a third output Y<3> and a fourth output Y<4>, respectively.

In addition, the third switch SW3 is provided between output nodes of the first output amplifier 139-1 and the third output amplifier 139-3.

The fourth switch SW4 is provided between output nodes of the second output amplifier 139-2 and the fourth output amplifier 139-4.

By sharing data between pixels having an identical polarity, the first output amplifier 139-1 and the third output amplifier 139-3 are connected by a switch, and the second output amplifier 139-2 and the fourth output amplifier 139-4 are connected by a switch.

The first switch SW1 and the second switch SW2 are respectively provided at an input node of the third output amplifier 139-3 and an input node of the fourth output amplifier 139-4.

Further, each switch SW1 to SW4 is controlled by an amplifier switch control signal AMP_SW_CONT.

Referring to FIG. 5B, an operation of the output buffer 139 will be described in detail.

A case in which an amplifier switch control signal AMP_SW_CONT is enabled will be described with reference to FIG. 5B.

The case in which the amplifier switch control signal AMP_SW_CONT is enabled denotes that the pixel data Data0 to Data3 of consecutive rows and adjacent pixels (based on columns) are identical.

In the above case, an operation of the output buffer 139 according to the exemplary embodiment will be described as follows.

When the amplifier switch control signal AMP_SW_CONT is enabled, an output amplifier receiving the signal is disabled, and a corresponding switch is turned on.

The third output amplifier 139-3 and the fourth output amplifier 139-4 are disabled by the enabled amplifier switch control signal AMP_SW_CONT. However, the third output amplifier 139-3 may share an output of the first output amplifier 139-1, and the fourth output amplifier 139-4 may share an output of the second output amplifier 139-2. Thus, although the third output amplifier 139-3 and the fourth output amplifier 139-4 are disabled, the outputs of the first output amplifier 139-1 and the second output amplifier 139-2 may be provided to output nodes of the third output amplifier 139-3 and the fourth output amplifier 139-4, respectively.

According to the exemplary embodiment, when pixel data between consecutive rows and adjacent pixels are identical, static current can be decreased by selectively disabling output amplifiers having an identical polarity condition of a gamma voltage.

Figure 6A:
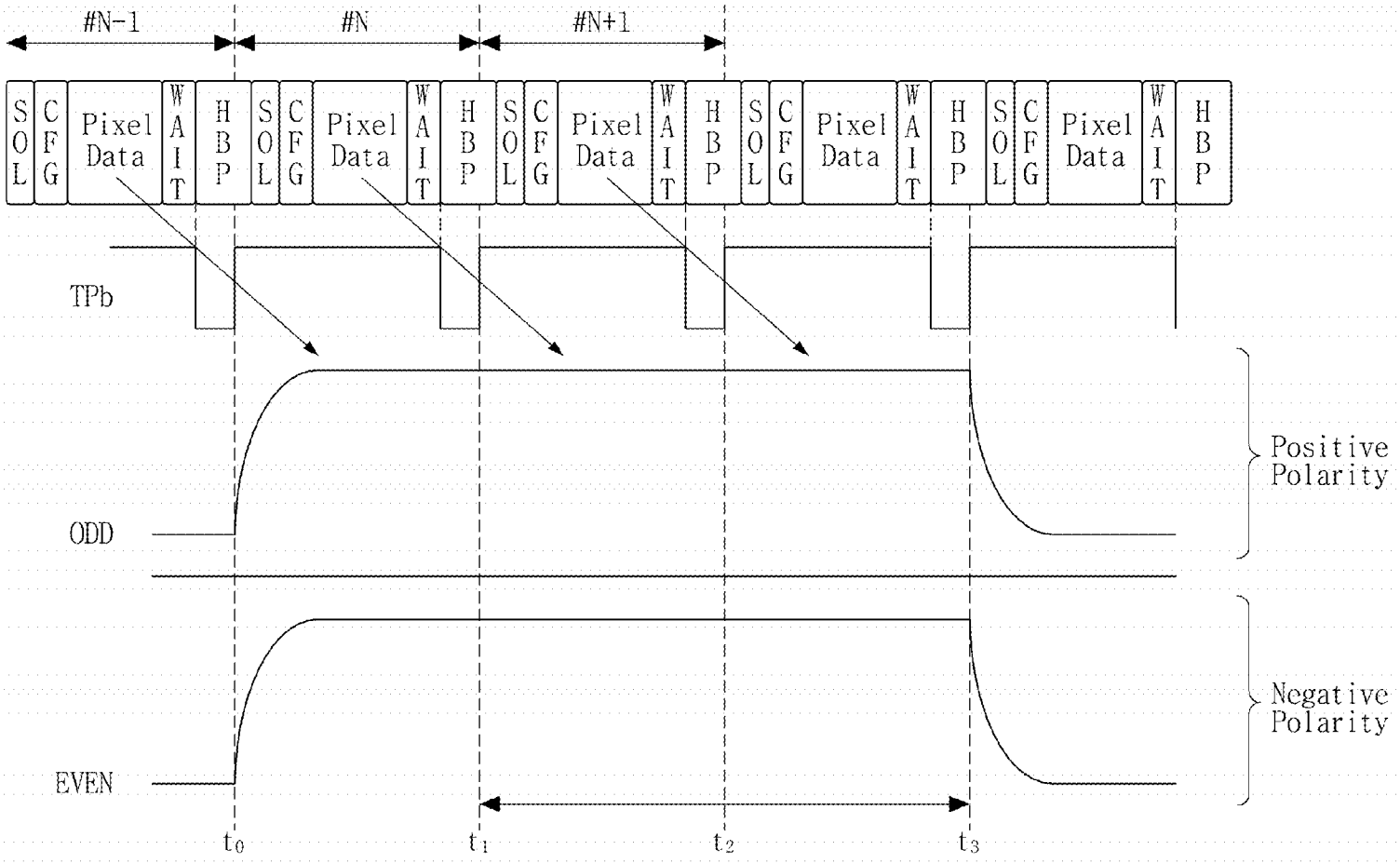
FIG. 6A is a gamma voltage graph when an interface packet is transmitted.

FIG. 6A is a gamma voltage graph when an interface packet is transmitted.

Referring to FIG. 6A, a packet is transmitted by a sequence of SOL, CFG, PIXEL DATA, WAIT, HBP, etc.

In a period of the PIXEL DATA, a data stream is substantially transmitted, and data of a previous row #N−1, a current row #N, and a subsequent row #N+1 is sequentially transmitted. Pixels in the same row are divided into odd columns ODD and even columns EVEN based on a column. FIG. 6A illustrates that a gamma voltage having positive (+) polarity is applied as current of the pixels in the odd columns ODD, and a gamma voltage having a negative (−) polarity is applied as current of the pixels in the even columns EVEN. A range of the gamma voltage having positive (+) polarity and a range of the gamma voltage having negative (−) polarity may be different. For example, the gamma voltage having positive (+) polarity may range from 9 V to 16 V, and the gamma voltage having negative (−) polarity may range from 0 V to 9 V.

When a new data stream is received from data of the previous row #N−1, and pixel data which is the same as data of the previous row #N−1 is continuously applied to the current row #N and the subsequent row #N+1, all output amplifiers may be enabled in a time period $t_0$ to $t_1$ when data of the previous row #N−1 is received.

However, some output amplifiers having identical polarity are disabled in a time period $t_1$ to $t_3$ when data of the current row #N and the subsequent row #N+1 is transmitted.

When new pixel data is applied again after time $t_3$, all of the output amplifiers may be enabled again after time $t_3$. Accordingly, a static power saved period in which static current is substantially reduced may be the time period $t_1$ to $t_3$.

FIG. 6B is a state table of output amplifiers according to a time period $t_0$ to $t_3$ in FIG. 6A.

FIG. 6B shows an example of output amplifiers 139-1 and 139-3 (see FIG. 5A) connected to odd columns.

Referring to FIGS. 5A and 6B, the first output amplifier 139-1 and the third output amplifier 139-3 are enabled (ON and ON) in a time period $t_0$ to $t_1$.

However, only the first output amplifier 139-1 is enabled and the third output amplifier 139-3 is disabled (ON and OFF) in a time period $t_1$ to $t_2$. Also, only the first output amplifier 139-1 is enabled and the third output amplifier 139-3 is disabled in a time period $t_2$ to $t_3$ (ON and OFF).

However, both the first and third output amplifiers 139-1 and 139-3 are again enabled to reset previous data (ON and ON) after time $t_3$ at which new data is applied to a row.

As described above, the exemplary embodiment o describes 2×2 pixels per unit, but is not limited thereto. The number of pixels per unit and a polarity configuration of a gamma voltage may be changed according to the intention of a designer or configuration specifications of a product.

FIG. 7 is a table illustrating serial data groups (SYNC_DATA) and comparison data (XOR_ODD and XOR_EVEN) when 6×6 pixels per unit are applied.

Referring to FIG. 7, when 6×6 pixels per unit are applied and data received in R, G, and B pixels may be transmitted using eight buses (not shown), the data is divided into individual serial data groups SYNC_DATA0 [7:0], SYNC_DATA1 [7:0], SYNC_DATA2 [7:0], SYNC_DATA3 [7:0], SYNC_DATA4 [7:0], and SYNC_DATA5 [7:0], and may be transmitted. Here, the number of buses is not limited to eight.

In the above case, it shows that comparison data XOR_ODD and XOR_EVEN may compare adjacent data based on six columns.

For example, each of a first column and a third column 1 and 3, a second column and a fourth column 2 and 4, a third column and a fifth column 3 and 5, and a fourth column and a sixth column 4 and 6, which are arranged in an identical row, are compared. Therefore, when the compared result is identical, "1" is transmitted, and when the comparison result is different, "0" is transmitted. Here, the above illustrates an example when positive (+) and negative (−) polarity of a gamma voltage is alternately applied, and it may compare by a different method rather than comparison of odd columns and even columns when a positive (+) polarity, a positive (+) polarity, a negative (−) polarity, and a negative (−) polarity are applied according to a design configuration. That is, when columns in which a polarity condition of a gamma voltage is identical are compared, it satisfies the aspect of the exemplary embodiment.

The exemplary embodiment is not intended to include a division into odd columns and even columns. When a polarity condition is identical and an amplifier is disabled, it may show an example of selectively enabling or disabling under a condition in which the gamma voltage polarity is identical.

A more detailed description will be described with subsequent drawings.

Figure 8A:
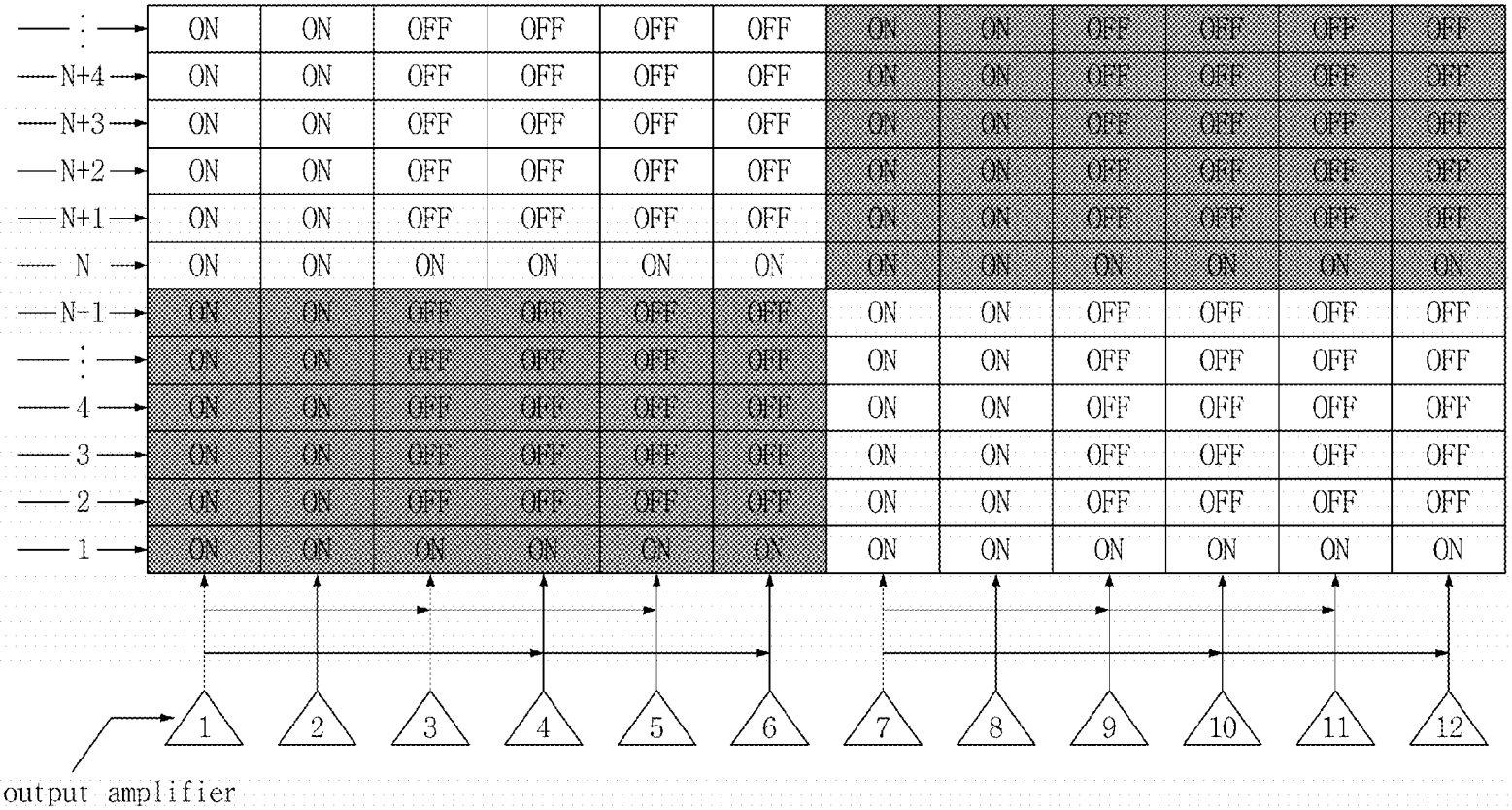
FIGS. 8A and 8B are views in which output amplifiers are enabled or disabled according to patterns when a thin film transistor (TFT) LCD device is applied.
Figure 8B:
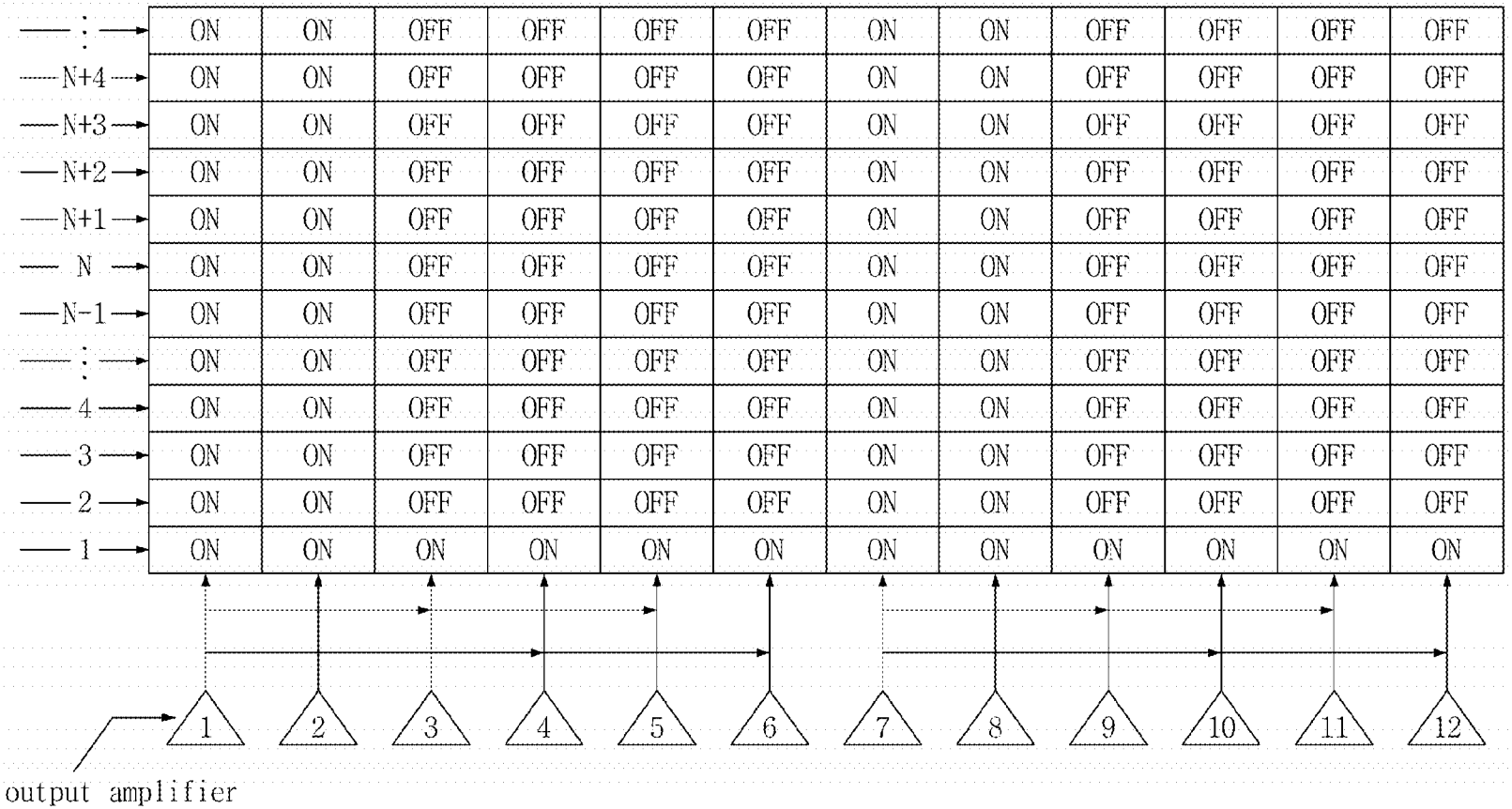

FIGS. 8A and 8B are tables in which output amplifiers are enabled or disabled according to patterns when a TFT LCD device having 6×6 pixels per unit is applied.

FIG. 8A is an example where a black-and-white mosaic pattern is applied.

When the panel 140 (see FIG. 1) is formed by 6×6 pixels per unit, it is assumed that the panel 140 circuitry provides six output amplifiers to control individual rows 1, 2 to N, N+1, and the like and columns.

When an identical value of pixel data corresponding to a black color is applied to first to $N-1^{th}$ rows, pixel data between pixels having identical polarity within six columns based on columns may be compared.

Each output amplifier connected to the first row is enabled.

However, in each output amplifier connected to the second row, whether each output amplifier is enabled or not may be controlled by comparing data between adjacent pixels (based on columns). Here, since the data of pixels in odd columns (first, third, and fifth columns) are identical, only a first output amplifier 1 is enabled, and third and fifth output amplifiers 3 and 5 are disabled. Further, output data of the first output amplifier 1 may be output to output terminals of the third and fifth output amplifiers 3 and 5. In addition, since the data of pixels in even columns (second, fourth, and sixth columns) are identical, only a second output amplifier 2 is enabled, and fourth and sixth output amplifiers 4 and 6 are disabled. Further, output data of the second output amplifier 2 may be output to output terminals of the fourth and sixth output amplifiers 4 and 6.

However, although pixel data different from a previous row, that is, an $N-1^{th}$ row, is applied to the $N^{th}$ row, all adjacent pixels (based on columns) have a data value corresponding to white.

In the above case, as described in FIG. 2, due to different pixel data according to the result by comparing pixel data between consecutive rows, the amplifier switch control signal AMP_SW_CONT (see FIG. 3) may be disabled.

Accordingly, since the amplifier switch control signal AMP_SW_CONT is disabled, output amplifiers controlled by the signal are enabled, and all switches are turned off. Consequently, output amplifiers 1 to 6 respectively connected to each pixel connected to the $N^{th}$ row are all enabled.

In the above case, based on 6×6 pixels per unit, since 20 output amplifiers of output amplifiers connected to 36 pixels are disabled, 55.6% of the current may be reduced when compared to the existing case.

FIG. 8B shows an example when all white is applied as a background color.

However, it is not limited thereto, and may include all cases such as all black, all gray, and all identical color (for example, green).

In the case of the background color, all output amplifiers 1 to 6 are enabled only for a first row, and one output amplifier 1 is enabled for odd columns and another output amplifier 2 is enabled for even columns, based on 6 columns from a subsequent row.

The above case may reduce the static current more than that described in FIG. 8A, and an effect of current reduction is further improved to 61.1%.

Figure 9:
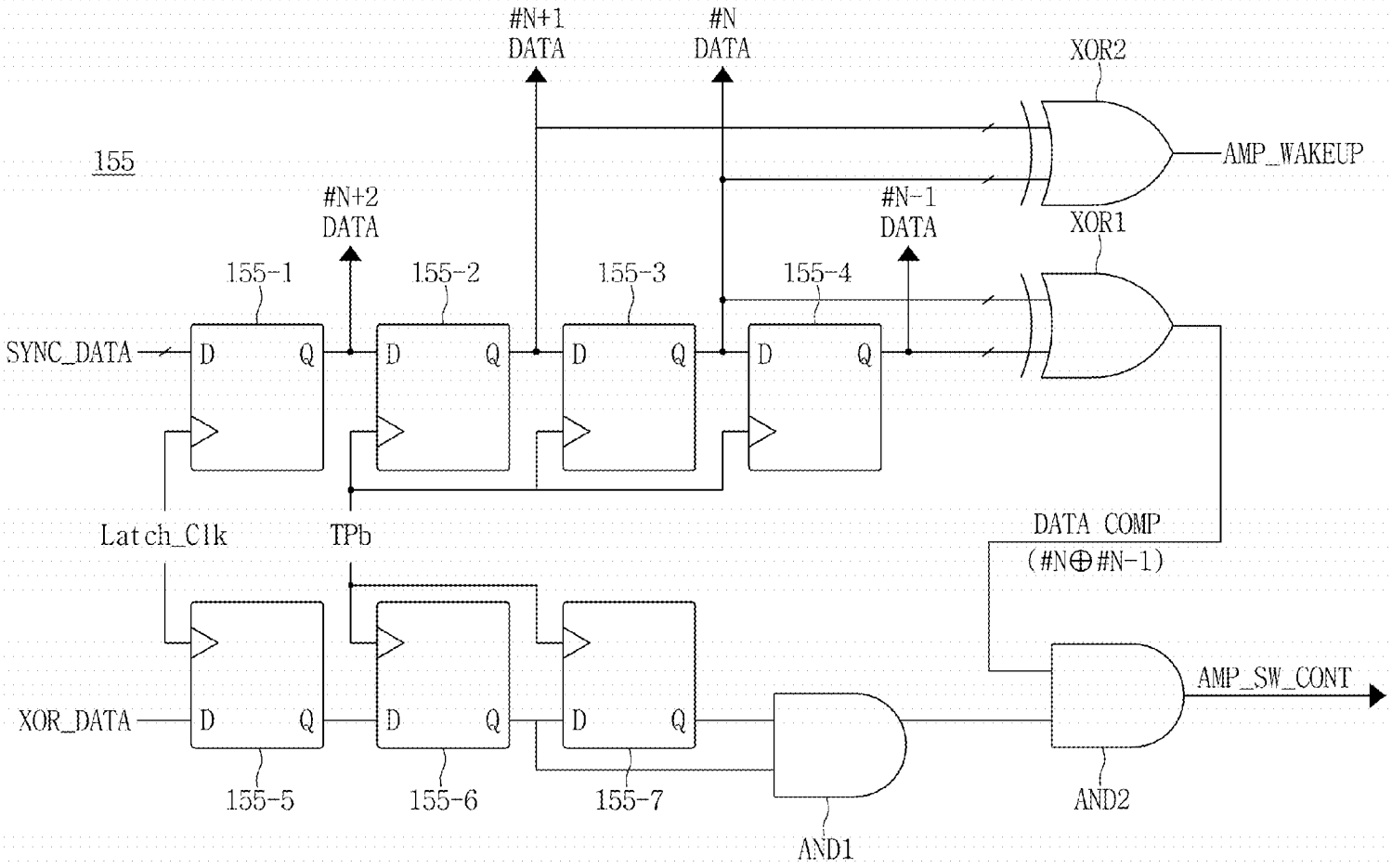
FIG. 9 is a block diagram of a data latch according to another exemplary embodiment.

FIG. 9 is a block diagram of a data latch 155 according to another exemplary embodiment.

The data latch 155 according to another exemplary embodiment may provide a wake-up signal AMP_WAKEUP to prepare in advance so that disabled amplifiers are enabled.

Referring to FIG. 9, the data latch 155 may include a plurality of flip-flops 155-1, 155-2, 155-3, 155-4, 155-5, 155-6, and 155-7, a first XOR device XOR1, a second XOR device XOR2, and first and second AND devices AND1 and AND2.

The first to fourth flip-flops 155-1, 155-2, 155-3, and 155-4 are connected in series, and data SYNC_DATA received in the first flip-flop 1135-1 may be transmitted serially. Here, the data is received through a row, that is, a gate line.

The XOR1 compares pixel data values in an $N^{th}$ row (#N DATA) and an $N-1^{th}$ row (#N−1 DATA) to determine whether the values are different or not. The XOR1 is a comparator, and may be changed to a comparison circuit or another circuit having a comparison function instead of an XOR gate.

Meanwhile, the XOR2 compares pixel data values in the $N^{th}$ row (#N DATA) and an $N+1^{th}$ row (#N+1 DATA) to determine whether the values are different or not. When the pixel data values in the $N^{th}$ row (#N DATA) and the $N+1^{th}$ row (#N+1 DATA) are different, an enabled amplifier wake-up signal AMP_WAKEUP is provided. Therefore, the data latch 155 according to another exemplary embodiment may detect a status in advance, in which amplifiers should be all enabled because data is changed, to prepare in advance so that disabled amplifiers are enabled.

In more detail, when a current row, e.g., the $N-1^{th}$ data (#N−1 DATA), is output, data to be applied to a row two stages later than the current row, i.e., #N+1 DATA, and data to be applied to a subsequent row, i.e., #N DATA, are compared in advance and a determination of whether disabled output amplifiers should be enabled may be prepared in a row two stages earlier than the current row. That is, instead of enabling an output amplifier when changed data is detected, an amplifier wake-up signal AMP_WAKEUP may be provided to the output amplifier to improve output characteristics thereof after detecting the changed data in advance.

The fifth to seventh flip-flops 155-5, 155-6, and 155-7 may transmit comparison data XOR_DATA serially.

Here, the comparison data XOR_DATA may denote the comparison data XOR_ODD and XOR_EVEN which are a comparison of odd columns and even columns as described in FIG. 3.

The first AND device AND1 performs a logical AND on output signals of the sixth flip-flop 155-6 and the seventh flip-flop 155-7.

The second AND device AND2 performs a logical AND on the comparison result of the XOR1 and comparison data XOR_DATA which is an output signal of the AND1, and outputs an output signal of the logical AND.

As described above, the data latch 155 according to another exemplary embodiment determines whether data of consecutive rows, i.e., a pixel data value of a current row and a pixel data value of a previous row, are identical. Therefore, when the comparison result between the pixel data value received in the previous row and the pixel data value received in the current row is identical, "1" is provided as the output signal, and when the result is different, "0" is provided as the output signal.

By determining whether pixel data values are identical or not by columns and simultaneously determining whether pixel data values of consecutive rows are identical or not, an enabled amplifier switch control signal AMP_SW_CONT is output when all of the pixel data values are determined as identical.

Furthermore, when the pixel data values of the consecutive rows are different, the amplifier wake-up signal AMP_WAKEUP is provided so as to prepare output amplifiers in disabled states in advance. Thus, the output amplifiers may be enabled in advance before receiving new data. Therefore, output characteristics of the output amplifier may be improved by preventing change of an output voltage transition when the disabled output amplifier is enabled.

Figure 10:
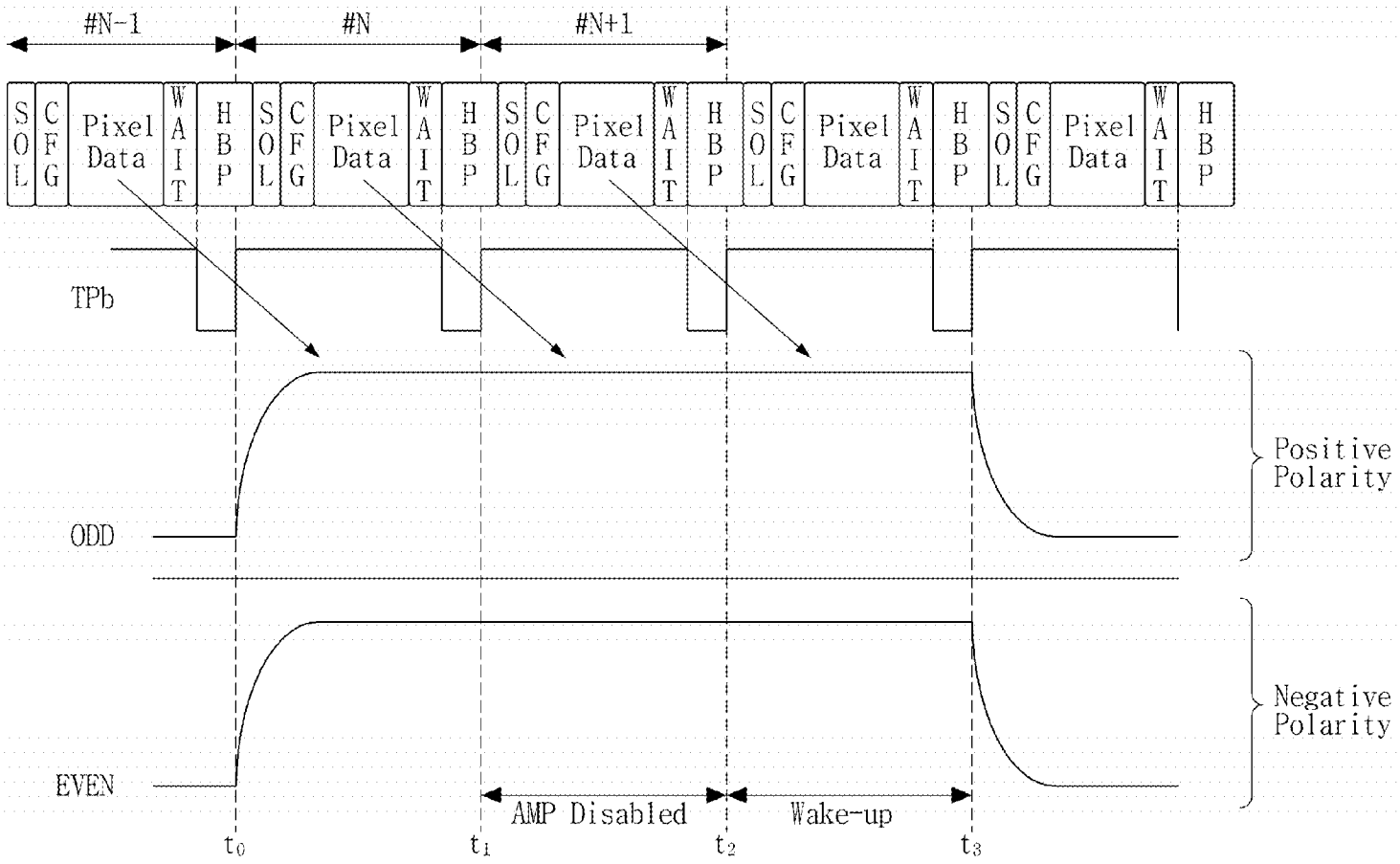
FIG. 10 is a gamma voltage graph when an interface packet is transmitted according to FIG. 9.

FIG. 10 is a gamma voltage graph when an interface packet is transmitted according to FIG. 9.

Referring to FIG. 10, a packet is transmitted by a sequence of SOL, CFG, PIXEL DATA, WAIT, HBP, etc.

Data stream is substantially transmitted in a period of the PIXEL DATA, that is, data in an $N-1^{th}$ row #N−1, an $N^{th}$ row #N, and an $N+1^{th}$ row #N+1 are transmitted.

Data in each row may be divided into odd columns and even columns based on columns. A positive (+) gamma voltage is applied to odd-column pixels and a negative (−) gamma voltage is applied to even-column pixels in FIG. 10. However, it is not limited thereto, and may be variously expressed based on a pixel configuration.

When a new data stream is started from the $N-1^{th}$ row #N−1, and the same pixel data as the $N-1^{th}$ row #N−1 is continuously applied to the $N^{th}$ row #N and $N+1^{th}$ row #N+1, all output amplifiers are enabled when the $N-1^{th}$ row #N−1 receives data.

In a time period $t_1$ to $t_2$, i.e., a period of transmitting data to the $N^{th}$ row #N, some of the output amplifiers having identical polarity are disabled.

When a new pixel data is applied again after time $t_3$, all of the output amplifiers may be enabled again after time $t_3$.

According to another exemplary embodiment, when pixel data values in the $N^{th}$ row # and the $N+1^{th}$ row #N+1 are different such as those described in FIG. 9, an enabled amplifier wake-up signal AMP_WAKEUP is provided. Accordingly, corresponding disabled output amplifiers may be enabled in advance using the amplifier wake-up signal AMP_WAKEUP in a time period $t_2$ to $t_3$.

In the above case, the time period $t_1$ to $t_2$ may be a period in which static current is substantially decreased.

Meanwhile, there are various types of methods which detect different pixel data values in the $N^{th}$ row #N and the $N+1^{th}$ row #N+1 and prepare output amplifiers in advance. For example, a method, which distributes a wake-up preparation time so as to prepare a wake-up signal in advance when data is input, may be used. Further, a method, which detects changed data in the TCON 110 (see FIG. 1) and provides a wake-up signal so as to prepare in advance, may be included. Here, this is an example of a simple method which detects different pixel data values in the $N^{th}$ row # and the $N+1^{th}$ row #N+1 and prepares the output amplifiers in advance, and it may be variously changed according to intention of a designer or a circuit configuration.

An aspect of the inventive concept is described with an example of the TFT LCD, but it is not limited thereto, and may be applied to an organic light-emitting diode (OLED) panel.

Figures 11A, 11B:
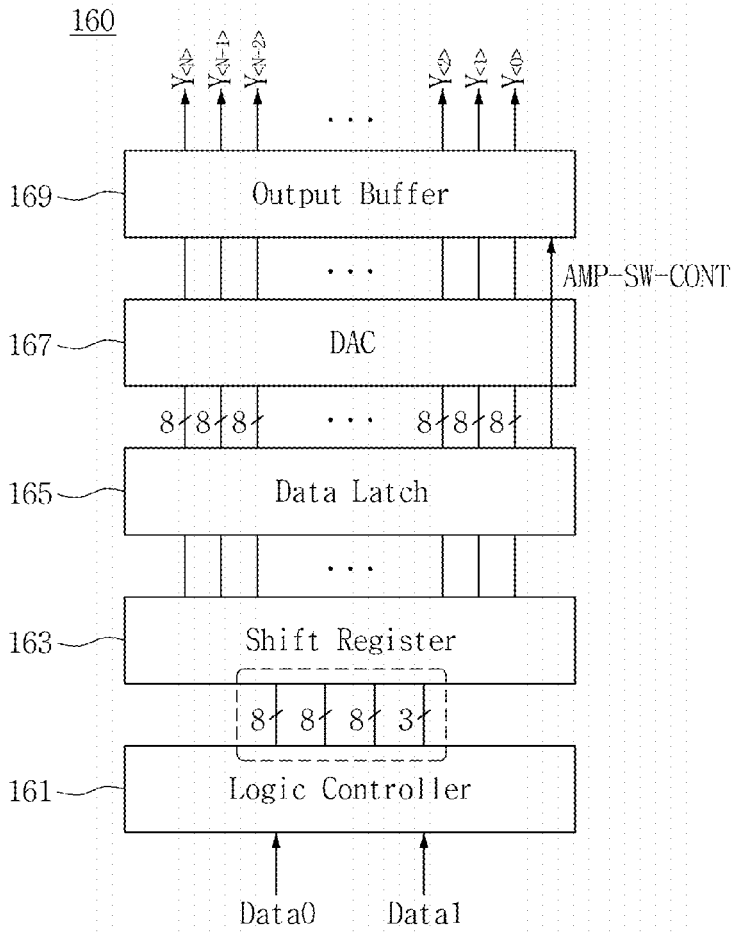
FIG. 11A is a block diagram of a source driver which controls an organic light-emitting diode (OLED) panel according to another exemplary embodiment.
FIG. 11B is an example table illustrating data groups and comparison data when an OLED panel is applied.

FIG. 11A is a block diagram of a source driver 160 which controls an OLED panel according to another exemplary embodiment.

Referring to FIG. 11A, a source driver 160 may include a logic controller 161, a shift register 163, a data latch 165, a DAC 167, and an output buffer 169.

The logic controller 161 receives input data Data0 and Data1 to provide to the shift register 163. Further, the logic controller 161 provides comparison data XOD_DATA to the shift register 163.

Here, as the comparison data XOR_DATA is result data by comparing pixels having identical pixel data among adjacent pixels, a determination of whether amplifiers of the source driver 160 should be enabled or not may be controlled using the comparison data XOR_DATA.

According to another exemplary embodiment, as the logic controller 161 compares data by color filters, whether output amplifiers with respect to channels having an identical gamma condition should be enabled or not may be determined.

The shift register 163 provides data received from logic controller 161 to the data latch 165. A plurality of shift registers (not shown) included in the shift register 163 sequentially shift image data, that is, input data D0P, D0N, D1P, and D1N, and comparison data XOR_DATA, using a shift clock and output the shifted image data.

The data latch 165 sequentially latches digital data in response to a sampling signal supplied from the shift register 163 to supply to the DAC 137. Further, the data latch 165 provides an amplifier switch control signal AMP-SW-CONT to the output buffer 169 using the comparison data XOR_DATA.

The DAC 167 may convert latched digital image data to analog image data. The DAC 167 converts the digital image data transmitted from the data latch 165 to analog image data, that is, a data voltage, to supply to the output buffer 169.

The output buffer 169 transmits the received analog image data to a data line (not shown) of an OLED panel (not shown) and output data Y<0> to Y<N> may be provided.

FIG. 11B is an example table illustrating data groups and comparison data when an OLED panel having 6×6 pixels per unit is applied.

The OLED uses a separate gamma voltage due to a filter in contrast with a TFT LCD. That is, in the case of R, G, and B pixels, all of the R pixels use an identical gamma voltage, all of the G pixels use an identical gamma voltage, and all of the B pixels use an identical gamma voltage.

Accordingly, in the case of the OLED, a comparison operation may be performed between pixels using an identical gamma voltage.

Referring to FIG. 11B, comparison data XOR_RED is generated between the R pixels, comparison data XOR_GREEN is generated between the G pixels, and comparison data XOR_BLUE is generated between the B pixels.

When data received in the R, G, and B pixels are transmitted using eight buses (not shown), the data may be transmitted after respectively dividing into serial data groups SYNC_DATA0 [7:0], SYNC_DATA1 [7:0], and SYNC_DATA2 [7:0].

In the above case, the comparison data XOR_RED, XOR_GREEN, and XOR_BLUE results from a determination of whether pixel data is identical or not based on the R, G, and B pixels.

FIG. 11B is an example when the R, G, and B pixels are sequentially formed, and a pixel selection for comparison may be different based on a filter arrangement when filters are differently arranged.

Although it is not shown, a case, in which an amplifier switch control signal AMP_SW_CONT is generated to selectively control output amplifiers using the comparison result of consecutive rows and the comparison data XOR_RED, XOR_GREEN, and XOR_BLUE, is the same as the exemplary embodiment.

Figure 12A:
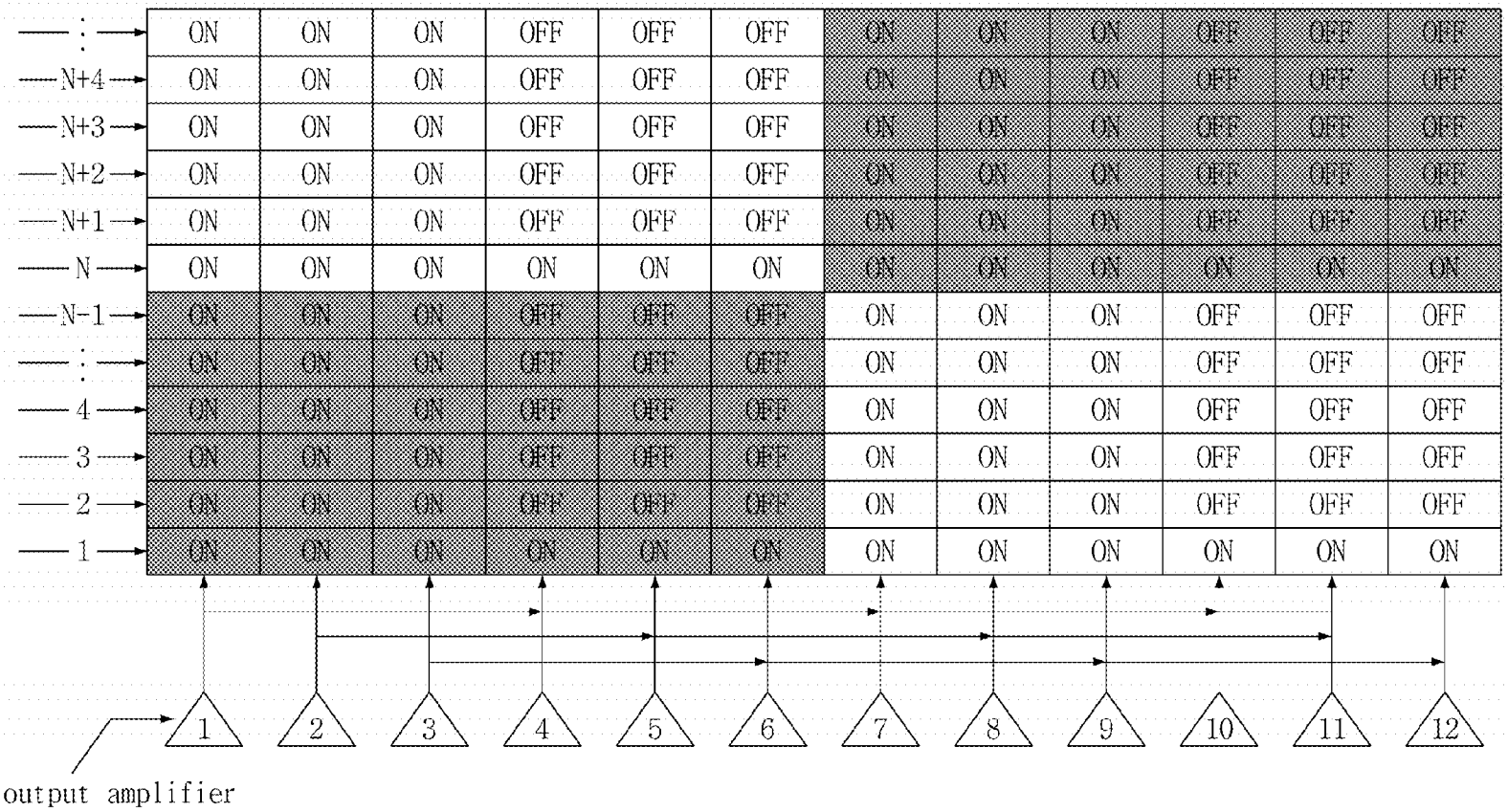
FIGS. 12A and 12B are views in which output amplifiers are enabled or disabled according to patterns when the OLED panel is applied.
Figure 12B:
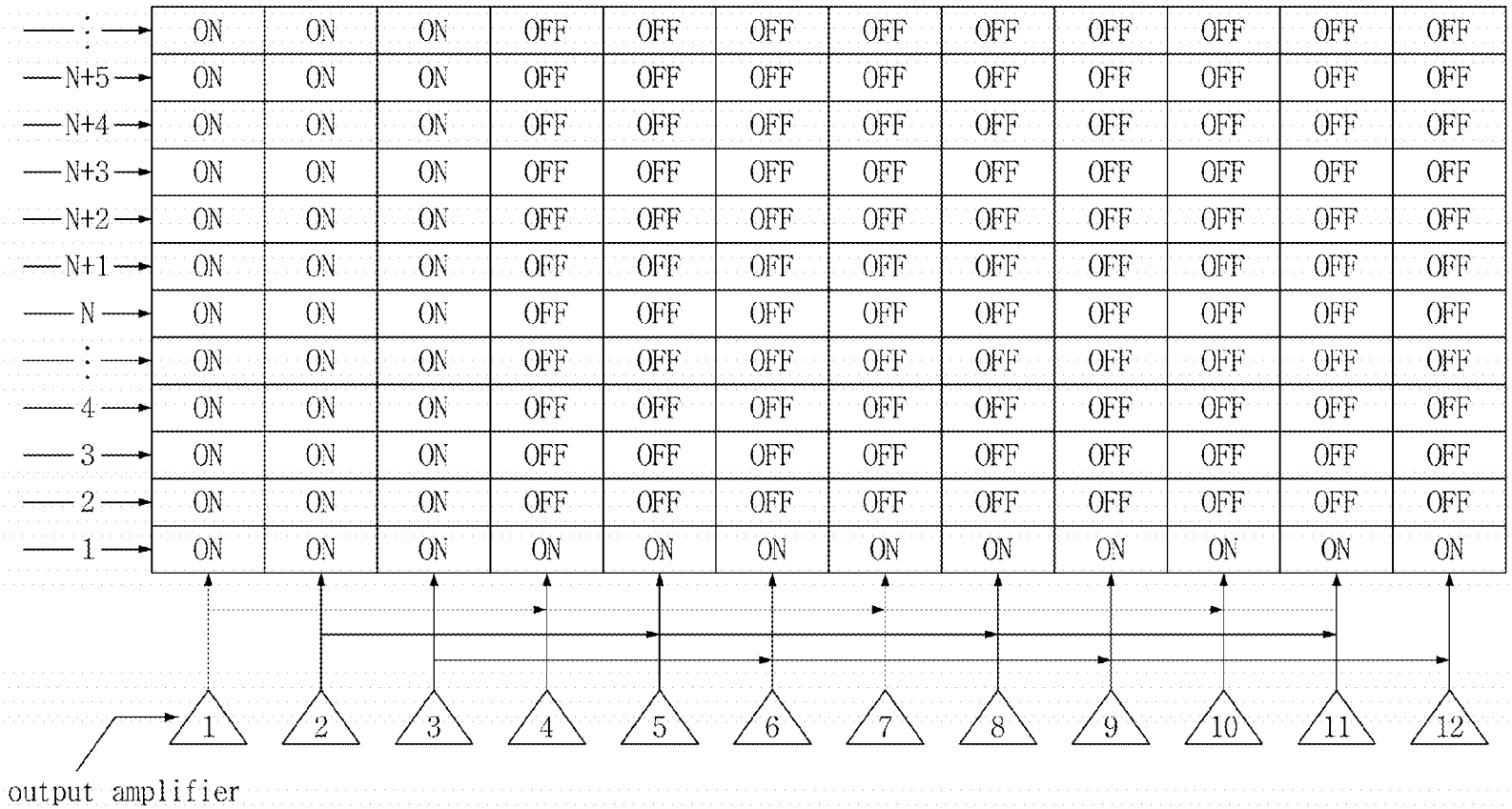

FIGS. 12A and 12B are tables in which output amplifiers are enabled or disabled according to patterns when the OLED panel having 6×6 pixels per unit is applied.

FIG. 12A is an example where a black-and-white mosaic pattern is applied.

When the OLED panel is formed by 6×6 pixels per unit, six output amplifiers are provided to control each row 1, 2 to N, N+1, and the like and columns.

When an identical value of pixel data corresponding to a black color is applied to first to $N-1^{th}$ rows, pixel data may be compared between pixels having identical polarity in six columns based on columns.

All output amplifiers connected to the first row is enabled.

However, each output amplifier connected to a second row may be controlled to be enabled or disabled by comparing data between adjacent pixels (based on columns). Here, since pixels have identical data due to filters (R, G, and B), first to third output amplifiers 1 to 3 are only enabled and fourth to sixth output amplifier 4 to 6 are disabled when the R, G, and B are regularly disposed. Further, output data of the first output amplifier 1 may be provided to an output terminal of the fourth output amplifier 4. Output data of the second output amplifier 2 may be provided to an output terminal of the fifth output amplifier 5. Output data of the third output amplifier 3 may be provided to an output terminal of the sixth output amplifier 6.

However, in the case of an $N^{th}$ row, adjacent pixels have identical data because all adjacent pixels have data values corresponding to white, but different pixel data from a previous row, that is, the $N-1^{th}$ row is applied. Since this case shows different pixel data according to comparison of pixel data in consecutive rows, the amplifier switch control AMP_SW_CONT (see FIG. 11A) may be disabled.

Accordingly, since the amplifier switch control signal AMP_SW_CONT is disabled, amplifiers 4 to 6 controlled by the signal are all enabled.

In the above case, since 15 amplifiers among amplifiers connected to 36 pixels are disabled based on 6×6 pixels per unit, 41.7% of current may be reduced when compared to the existing case.

FIG. 12B is an example when all white is applied as a background color.

However, it is not limited thereto, and may include all cases having the same pattern, that is, all black, all gray, and all identical color (e.g., green).

In the case of all background, all output amplifiers are enabled only for a first row, and output of identical rows may be controlled by three channels of R, G, and B without a limit of six columns from a subsequent row. That is, output amplifiers 1 to 3 are only enabled by R, G, and B per row.

Static current shown in FIG. 12B is further reduced when compared to that shown in FIG. 12A, and a current reduction effect is further improved to 68.8%. However, the number of output amplifiers may be adjusted in consideration of resistance and output characteristics of each switch thereof.

As described above, according to the exemplary embodiments, data between consecutive rows and between adjacent pixels having identical data characteristics is compared, and then output amplifiers are selectively disabled when the data is identical. Thus, the static current of the OLED panel is reduced and an operation thereof is also stably supported. Therefore, an image having a high resolution can be assured when pixel data is changed.

Figure 13:
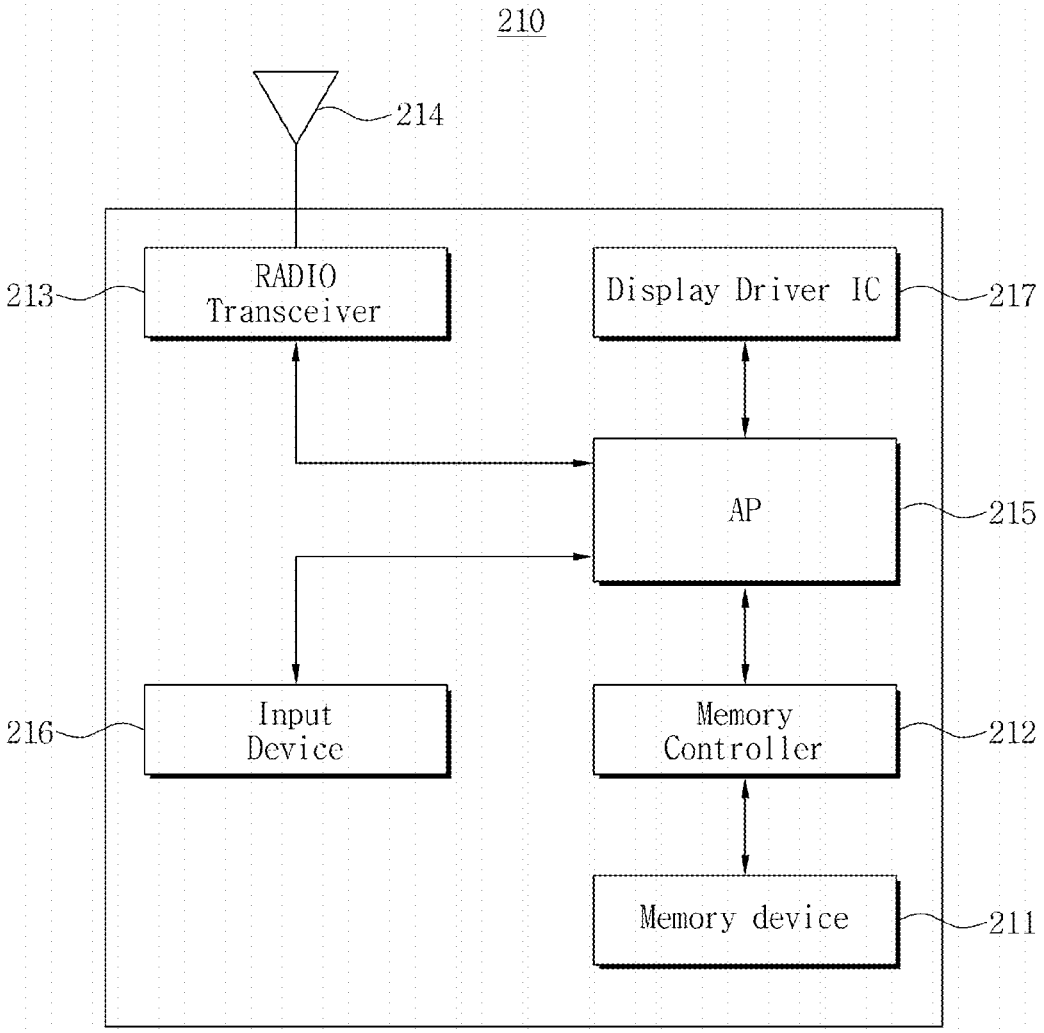
FIG. 13 is a block diagram of a computer system including the LCD device shown in FIG. 1 according to an exemplary embodiment.

FIG. 13 is a block diagram of a computer system 210 including the LCD device 100 shown in FIG. 1 according to an exemplary embodiment.

Referring to FIG. 13, the computer system 210 may include a memory device 211, a memory controller 212 which controls the memory device 211, a radio transceiver 213, an antenna 214, an application processor (AP) 215, an input device 216, and a display driver IC (DDI) 217.

The radio transceiver 213 may exchange a wireless signal through the antenna 214. For example, the radio transceiver 213 may change a wireless signal received through the antenna 214 to a signal to be processed in the AP 215.

The AP 215 may process a signal output from the radio transceiver 213 and transmit the processed signal to the DDI 217. Further, the radio transceiver 213 may change a signal output from the AP 215 to a wireless signal and output the changed wireless signal to an external device through the antenna 214.

The input device 216 is a device capable of inputting a control signal for controlling an operation of the AP 215 or data to be processed by the AP 215, and may be embodied as a pointing device such as a touch pad or computer mouse, keypad, or keyboard.

In some embodiments, the memory controller 212 for controlling an operation of the memory device 211 may be embodied as a part of the AP 215, and also embodied as a separate chip from the AP 215.

In some embodiments, the DDI 217 may be embodied as the LCD device 100 shown in FIG. 1, and operated at a low power.

Figure 14:
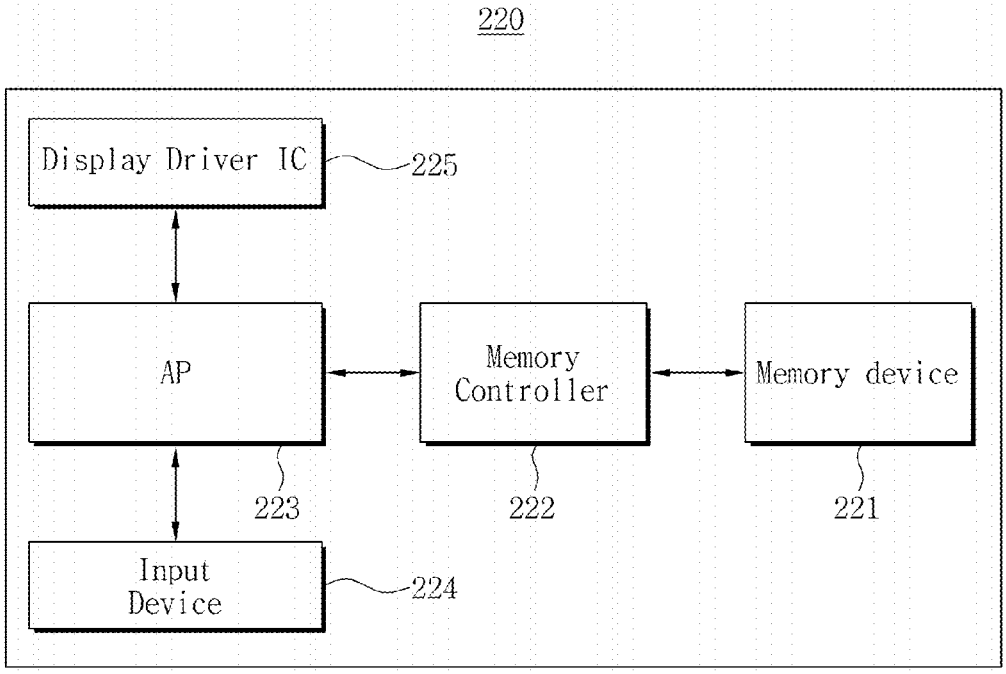
FIG. 14 is a block diagram of a computer system including the LCD device shown in FIG. 1 according to another exemplary embodiment o.

FIG. 14 is a block diagram of a computer system 220 including the LCD device 100 shown in FIG. 1 according to another exemplary embodiment.

Referring to FIG. 14, the computer system 220 may be embodied as a personal computer (PC), a network server, a tablet PC, a net-book, an e-reader, a personal digital assistant (PDA), a portable multimedia player (PMP), an MP3 player, or an MP4 player.

The computer system 220 may include a memory device 221, a memory controller 222 for controlling a data process operation of the memory device 221, an AP 223, an input device 224, and a DDI 225.

The AP 223 may display data stored in the memory device 221 through the DDI 225 according to data input through the input device 224. For example, the input device 224 may be embodied as a pointing device such as a touch pad or computer mouse, keypad, or keyboard. The AP 223 may control overall operations of the computer system 220, and control an operation of the memory controller 222.

In some embodiments, the memory controller 222 for controlling an operation of the memory device 221 may be embodied as a part of the AP 223, and also embodied as a separate chip from the AP 223.

In some embodiments, the DDI 225 may be embodied as the LCD device 100 shown in FIG. 1, and operated at a low power.

Figure 15:
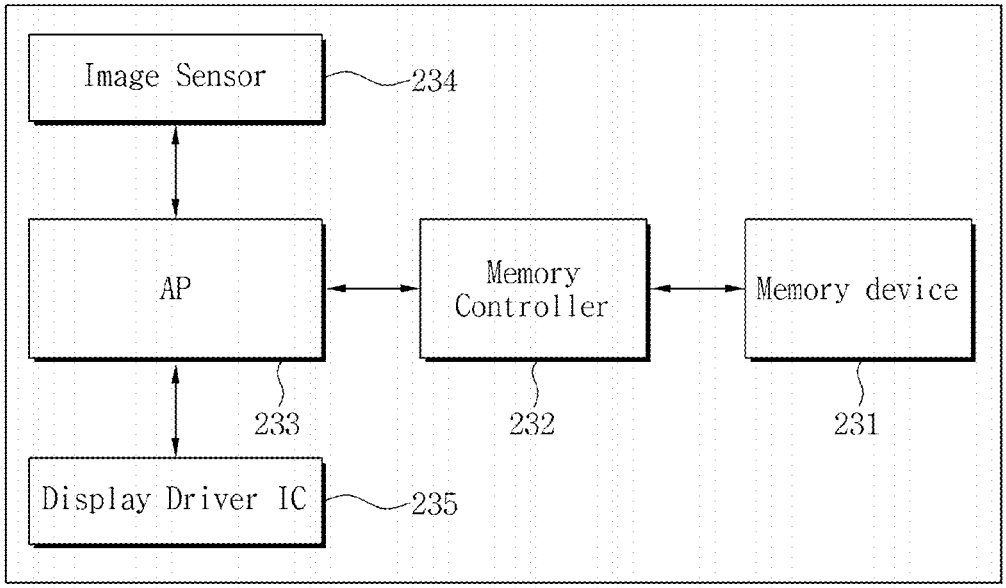
FIG. 15 is a block diagram of a computer system including the LCD device shown in FIG. 1 according to another exemplary embodiment.

FIG. 15 is a block diagram of a computer system 230 including the LCD device 100 shown in FIG. 1 according to another exemplary embodiment.

Referring to FIG. 15, the computer system 230 may be embodied as an image process device such as a digital camera or a mobile phone including the digital camera, a smart phone, or a tablet PC.

The computer system 230 may include a memory device 231, a memory controller 232 for controlling a data process operation of the memory device 231 such as a write operation or read operation, an AP 233, an image sensor 234, and a DDI 235.

The image sensor 234 converts an optical image to digital signals, and the converted digital signals are transmitted to the AP 233 or the memory controller 232. The converted digital signals may be displayed through the DDI 235, or stored in the memory device 231 through the memory controller 232 according to control of the AP 233.

Further, data stored in the memory device 231 is displayed through the DDI 235 according to control of the AP 233 or the memory controller 232.

In some embodiments, the memory controller 232 for controlling an operation of the memory device 231 may be embodied as a part of the AP 233, and also embodied as a separate chip from the AP 233.

In some embodiments, the DDI 235 may be embodied as the LCD device 100 shown in FIG. 1, and operated at a low power.

According to an exemplary embodiment, static current can be decreased in the LCD device by selectively disabling output amplifiers with respect to pixels having identical data. Further, leakage current generated from the output amplifiers can be prevented when data is changed by comparing pixel data in adjacent rows and adjacent columns.

While the inventive concept has been described with reference to exemplary embodiments, it will be understood by those skilled in the art that various changes and modifications may be made without departing from the spirit and scope of the inventive concept as defined by the appended claims. Therefore, it should be understood that the above exemplary embodiments are not limiting, but illustrative. Thus, the scopes of the inventive concepts are to be determined by the broadest permissible interpretation of the following claims and their equivalents, and shall not be restricted or limited by the foregoing description.

What is claimed is:

1. A source driver comprising:

a plurality of output amplifiers configured to drive data lines of a display panel; and a data latch configured to determine whether data in a previous gate line is identical to data in a current gate line, determine whether data of adjacent data lines in the display panel are identical, selectively disable output amplifiers connected to the data line having identical data, and enable all of the plurality of output amplifiers in response to determining that data of the previous gate line and the current gate line are different while data of adjacent data lines are same.

2. The source driver of claim 1, further comprising:

a logic controller configured to receive input data and provide a comparison result between data of the adjacent data lines;

a shift register configured to provide the input data and the comparison result transmitted from the logic controller using a shift clock;

a digital-to-analog (DA) converter configured to convert data transmitted from the data latch to an analog voltage; and an output buffer configured to output data transmitted from the DA converter, wherein the data latch is further configured to sequentially latch data transmitted from the shift register.

3. The source driver of claim 2, wherein the logic controller compares data of the adjacent data lines, and provides "1" when the data is identical or "0" when the data is different as the comparison result.

4. The source driver of claim 2, wherein the data latch controls the output amplifier to be enabled or disabled using the comparison result between data of the gate lines and the comparison result between data of the adjacent data lines.

5. The source driver of claim 4, wherein the data latch selectively disables some of the output amplifiers connected to the data line in response to determining that the comparison result between data of the gate lines and the comparison result between data of the adjacent data lines are identical.

6. The source driver of claim 2, wherein the plurality of output amplifiers are selectively enabled or disabled according to an amplifier switch control signal, and wherein the data latch provides an enabled amplifier switch control signal if data of consecutive gate lines and data of adjacent data lines are same, and provides a disabled amplifier switch control signal if data of consecutive gate lines and data of adjacent data lines are different.

7. A liquid crystal display (LCD) device comprising:

a display panel comprising a plurality of data lines; and a source driver comprising a plurality of output amplifiers configured to drive the plurality of data lines, wherein the source driver adjusts current of the plurality of output amplifiers based on a comparison result of whether image data of adjacent columns is identical or not, and a comparison result of whether image data of consecutive rows is identical or not.

8. The device of claim 7, wherein a condition of a gamma voltage applied to the data line disposed in the columns is used when comparing whether image data is identical or not by the columns.

9. The device of claim 8, further comprising:

a timing controller configured to receive the image data and provide a timing related signal and an operation control signal;

a gate driver configured to provide a gate turn-on voltage controlled by the timing controller; and a panel configured to include a plurality of unit pixels at intersections of a plurality of gate lines and a plurality of data lines and display an image controlled by the gate driver and the source driver, wherein the source driver is controlled by the timing controller and provides pixel data corresponding to the image data.

10. The device of claim 9, wherein the source driver comprises:

a logic controller configured to receive the image data and provide a comparison result of mutual image data when data lines have an identical condition of the gamma voltage;

a shift register configured to provide the image data and the comparison result transmitted from the logic controller using a shift clock;

a data latch configured to sequentially latch data transmitted from the shift register and compare image data in a current row with image data in a subsequent row;

a DA converter configured to convert data transmitted from the data latch to an analog voltage; and an output buffer including the plurality of output amplifiers which output data transmitted from the DA converter.

11. The device of claim 10, wherein the logic controller performs a comparison operation on columns having identical polarity of a gamma voltage applied to each column when the panel includes a thin film transistor (TFT) liquid crystal display (LCD) device.

12. The device of claim 10, wherein the logic controller performs a comparison operation on columns in which identical color filters are disposed, when the panel includes an organic light-emitting diode (OLED) device.

13. The device of claim 10, wherein the data latch provides an enabled amplifier switch control signal when data of the consecutive rows is identical and data of columns having an identical condition of a gamma voltage is identical.

14. The device of claim 13, wherein a static current of output amplifiers is reduced in response to receiving the enabled amplifier switch control signal.

15. The device of claim 14, wherein the output amplifiers in which the static current is reduced are some output amplifiers connected to pixels disposed in the columns having the identical condition of the gamma voltage.

16. The device of claim 15, wherein a switch is connected between output nodes of the output amplifiers connected to the pixels disposed in the columns having the identical condition of the gamma voltage.

17. The device of claim 7, wherein the source driver enables all of the plurality of output amplifiers in response to determining that data of consecutive gate lines are different while data of adjacent data lines are same.

18. A liquid crystal display (LCD) device comprising:

a display panel comprising a plurality of data lines; and a source driver comprising a plurality of output amplifiers configured to drive the plurality of data lines, wherein the source driver controls some of the plurality of output amplifiers connected to columns with respect to columns which display an identical image to be selectively disabled according to determining of whether data of current row and subsequent rows are changed.

19. The LCD device of claim 18, wherein the source driver uses a gamma voltage condition applied to pixels disposed in the columns when determining whether the image data is identical or not by the columns.

20. The LCD device of claim 18, wherein the source driver provides an amplifier switch control signal which selectively disables output amplifiers connected to the columns having identical image data by determining whether image data of consecutive rows and adjacent columns is identical.

* * * * *